US012644343B1

(12) United States Patent
Wang et al.

(10) Patent No.: US 12,644,343 B1
(45) Date of Patent: Jun. 2, 2026

(54) SHOCK ISOLATOR FOR DOWNHOLE WELL DRILLING

(71) Applicant: MS Directional, LLC, Conroe, TX (US)

(72) Inventors: Jianke Wang, Conroe, TX (US); Derek Thomas Koller, Magnolia, TX (US)

(73) Assignee: MS DIRECTIONAL, LLC, Conroe, TX (US)

( * ) Notice: Subject to any disclaimer, the term of this patent is extended or adjusted under 35 U.S.C. 154(b) by 181 days.

(21) Appl. No.: 18/512,665

(22) Filed: Nov. 17, 2023

Related U.S. Application Data

(60) Provisional application No. 63/384,514, filed on Nov. 21, 2022.

(51) Int. Cl.
*E21B 17/07* (2006.01)

(52) U.S. Cl.
CPC ..... *E21B 17/07* (2013.01)

(58) Field of Classification Search
CPC ..... E21B 47/017; E21B 17/07; E21B 47/01
See application file for complete search history.

(56) References Cited

U.S. PATENT DOCUMENTS

| | | | | |
|---|---|---|---|---|
| 4,186,569 | A * | 2/1980 | Aumann | F16D 3/06 175/321 |
| 10,480,260 | B2 | 11/2019 | Brown et al. | |
| 10,982,492 | B1 | 4/2021 | Gopalan | |
| 2023/0295991 | A1 * | 9/2023 | Harvey | F16F 15/023 175/56 |

* cited by examiner

*Primary Examiner* — Tara Schimpf
*Assistant Examiner* — Lamia Quaim
(74) *Attorney, Agent, or Firm* — Jackson Walker LLP

(57) ABSTRACT

The disclosure provides an improved shock isolator having one or more features of: bidirectional variable metered hydraulic damping orifice; unidirectional flow valve for higher compression damping yet faster rebounding for reset; diverse spring styles for rebound and for compression; scalable back pressure for more efficient hydraulic damping; involute spline for higher torque loading capacity; progressive disk spring assemblies to expand operating frequency range and longevity; spring stack assemblies conform to establish more uniform loading during a stroke.

25 Claims, 18 Drawing Sheets

SHOCK ISOLATOR FOR DOWNHOLE WELL DRILLING

CROSS REFERENCE TO RELATED APPLICATIONS

This application claims the benefit of US. Provisional Ser. No. 63/384,514, entitled "Shock Isolator for Downhole Well Drilling", filed Nov. 21, 2022, which is incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to downhole well equipment used for drilling. More specifically, the disclosure relates to shock isolators for use while drilling downhole, such as with a drill collar for Measurement While Drilling ("MWD") or Logging While Drilling ("LWD") tools or more generally with drill string while drilling a wellbore for a well.

Description of the Related Art

Drilling deep hydrocarbon wells creates significant stresses on equipment. Particularly, hydrocarbon wells often have depths of miles. The miles of drilling have sensitive measurement and logging equipment to provide feedback to surface crews during the drilling process for location, actual direction compared to target directions, speed of bit, and other criteria. Downhole shocks with the magnitude of 500 gravities ("Gs") and more (up to 1000 Gs) have been encountered and reported. Few devices can handle the shock and vibrations of such rugged environments.

A shock isolator provides a unique function of needing to isolate frequent heavy shocks, and yet still isolate low frequency vibrations with lighter shocks. The response time is also challenging. The shock isolator needs to be able to isolate and return to ready position in very short periods of a few milliseconds to adequately isolate a shock and be ready for the next shock.

Typical shock isolators are challenged to meet the rigors of the needs. Typical shock isolators have one or more of the common issues in performance: inadequate and short lived configurations for compression and return strokes; inadequate and failure-prone springs for improper compression and return; inadequate spring assemblies causing non-uniform loading throughout a spring assembly resulting in early failure, inadequate valving for fluid flow through the shock isolator for timely stroke recovery from compression to return; early failure of spline torque transfer gearing; and others.

Thus, there remains a need for improvements in shock isolators.

BRIEF SUMMARY OF THE INVENTION

The disclosure provides an improved shock isolator having one or more features of: bidirectional variable metered hydraulic damping orifice; unidirectional flow valve for higher compression damping yet faster rebounding for reset; diverse spring styles for compression and rebound; scalable back pressure for more efficient hydraulic damping; involute spline for higher torque loading capacity; progressive disk spring assemblies to expand operating frequency range and longevity; spring stack assemblies to establish more uniform loading during a stroke.

The disclosure provides a shock isolator for downhole well drilling, comprising: a housing having an inner periphery; and a damper piston subassembly having a damper piston configured to be inserted into the inner periphery, having an outer periphery smaller than the inner periphery to form an annular orifice between the housing and the damper piston subassembly, the damper piston subassembly configured to allow movement longitudinally relative to the housing, the damper piston formed with a longitudinal variable depth damping orifice on the outer periphery of the damper piston, the damping orifice having a taper on a first end of the damping orifice, and a second taper on a second end of the damping orifice that forms a variable flow zone for fluid based on a relative position of the damper piston subassembly in the housing and configured to control a damping and response time of the shock isolator to reciprocal compression and return.

The disclosure also provides a shock isolator for downhole well drilling, comprising: a housing having an inner periphery; a damper piston subassembly having a damper piston configured to be inserted into the inner periphery having an outer periphery smaller than the inner periphery, the damper piston subassembly configured to allow movement longitudinally relative to the housing, and the damper piston having a longitudinal piston opening formed inward of the outer periphery; a unidirectional valve having a sealing portion flexibly coupled over an end of the piston opening across a face of the damper piston and having a hub portion fixedly coupled to the face distal from the piston opening and configured to allow the unidirectional valve to longitudinally bend away from the face and allow flow through the piston opening in a first direction and longitudinally close over the face to restrict flow in a second direction to control a damping and response time of the shock isolator to reciprocal compression and return; and a limit plate coupled with the unidirectional valve and the damper piston that forms a travel space between the face of the damper piston and a face of the limit plate, the face of the limit plate having a taper that longitudinally progressively increases a travel space as a distance from the hub portion to the sealing portion increases.

DETAILED DESCRIPTION

Figure 1B:
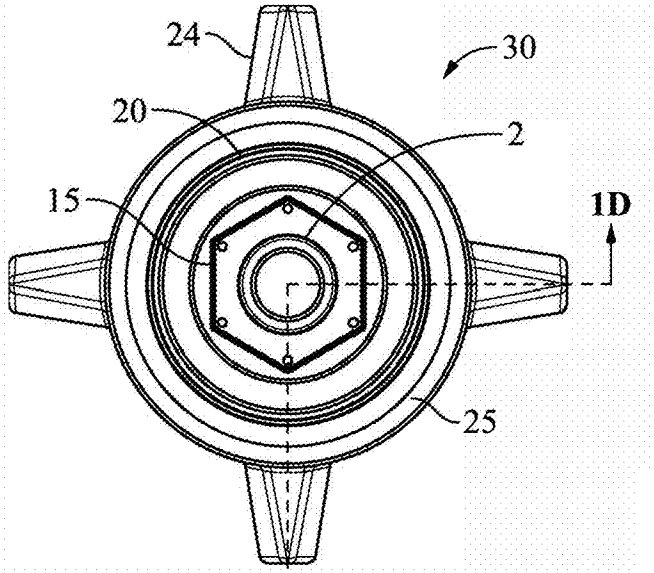
FIG. 1B is a schematic transverse cross-sectional view of the embodiment shown in FIG. 1A denoting the planes that form the longitudinal cross-sectional view of FIG. 1C.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, or with time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms "top", "up", "upper", "upward", "bottom", "down", "lower", "downward", and like directional terms are used to indicate the direction relative to the figures and their illustrated orientation and are not absolute relative to a fixed datum such as the earth in commercial use, unless specifically indicated otherwise. The term "inner," "inward," "internal" or like terms refers to a direction facing toward a center portion of an assembly or component, such as longitudinal centerline of the assembly or component, and the term "outer," "outward," "external" or like terms refers to a direction facing away from the center portion of an assembly or component. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Some elements are nominated by a device name for simplicity and would be understood to include a system of related components that are known to those with ordinary skill in the art and may not be specifically described. Various examples are provided in the description and figures that perform various functions and are non-limiting in shape, size, description, but serve as illustrative structures that can be varied as would be known to one with ordinary skill in the art given the teachings contained herein. As such, the use of the term "exemplary" is the adjective form of the noun "example" and likewise refers to an illustrative structure, and not necessarily a preferred embodiment. Element numbers with suffix letters, such as "A", "B", and so forth, are to designate different elements within a group of like elements having a similar or related structure or function, and corresponding element numbers without the letters are to generally refer to one or more of the like elements. Any element numbers in the claims that correspond to elements disclosed in the application are illustrative and not exclusive, as several embodiments may be disclosed that use various element numbers for like elements. The inclusion of a described element number in a Figure does not preclude the same element number being used in another Figure without another description, as the other Figure may show details and context not readily discernible in the described Figure.

The disclosure provides an improved shock isolator having one or more features of: bidirectional variable metered hydraulic damping; unidirectional flow valve for higher compression damping yet faster rebounding for reset; diverse spring styles for rebound and for compression; scalable back pressure for more efficient hydraulic damping; involute spline for higher torque loading capacity; progressive disk spring assemblies to expand operating frequency range and longevity; spring stack assemblies conform to establish more uniform loading during a stroke.

Figure 1A:
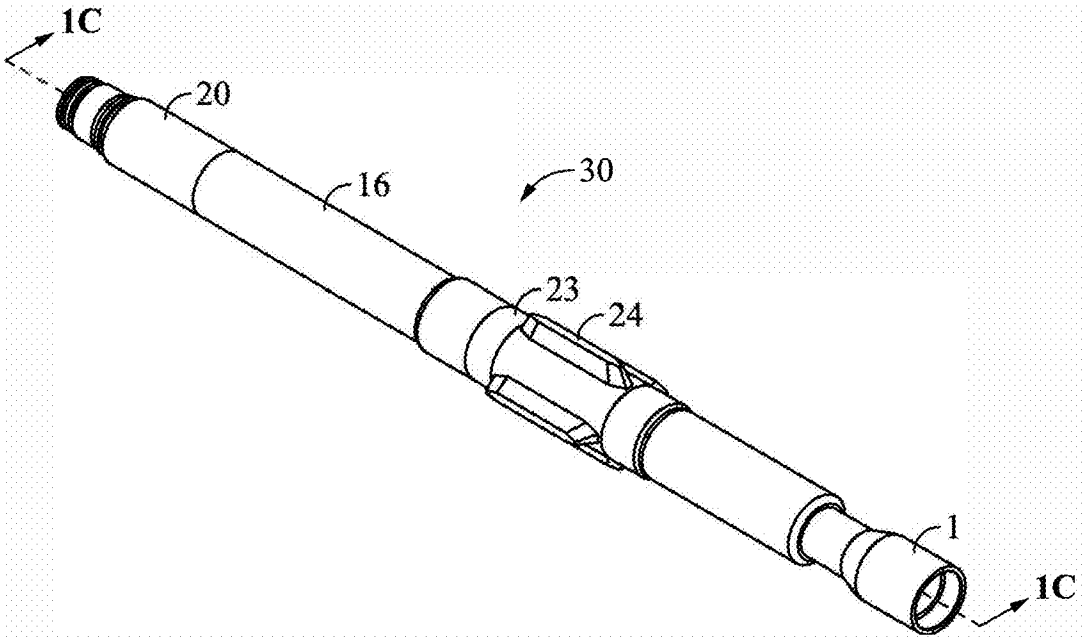
FIG. 1A is a schematic perspective view of an exemplary embodiment of a shock isolator of the present invention.
Figure 1C:
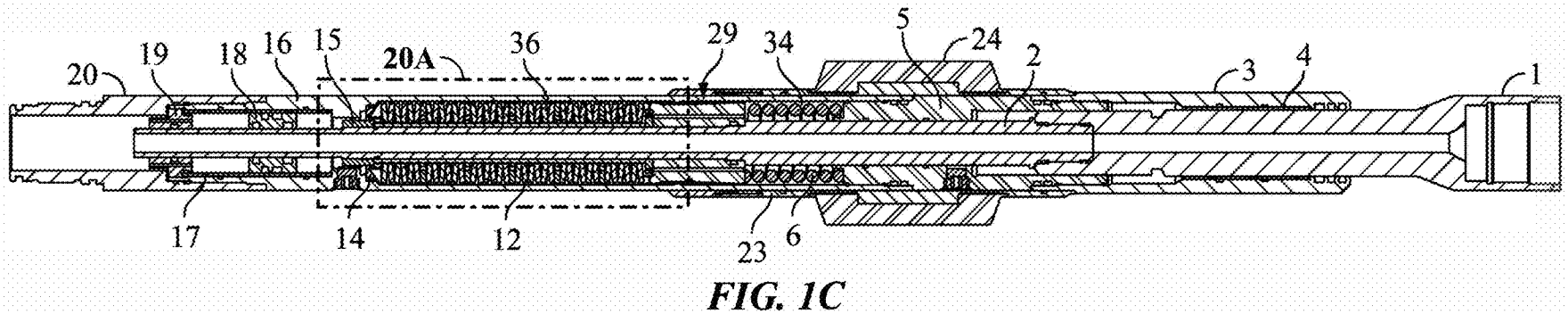
FIG. 1C is a schematic longitudinal cross-sectional view of the embodiment shown in FIG. 1A with the orientation shown in FIG. 1B.
Figure 1D:
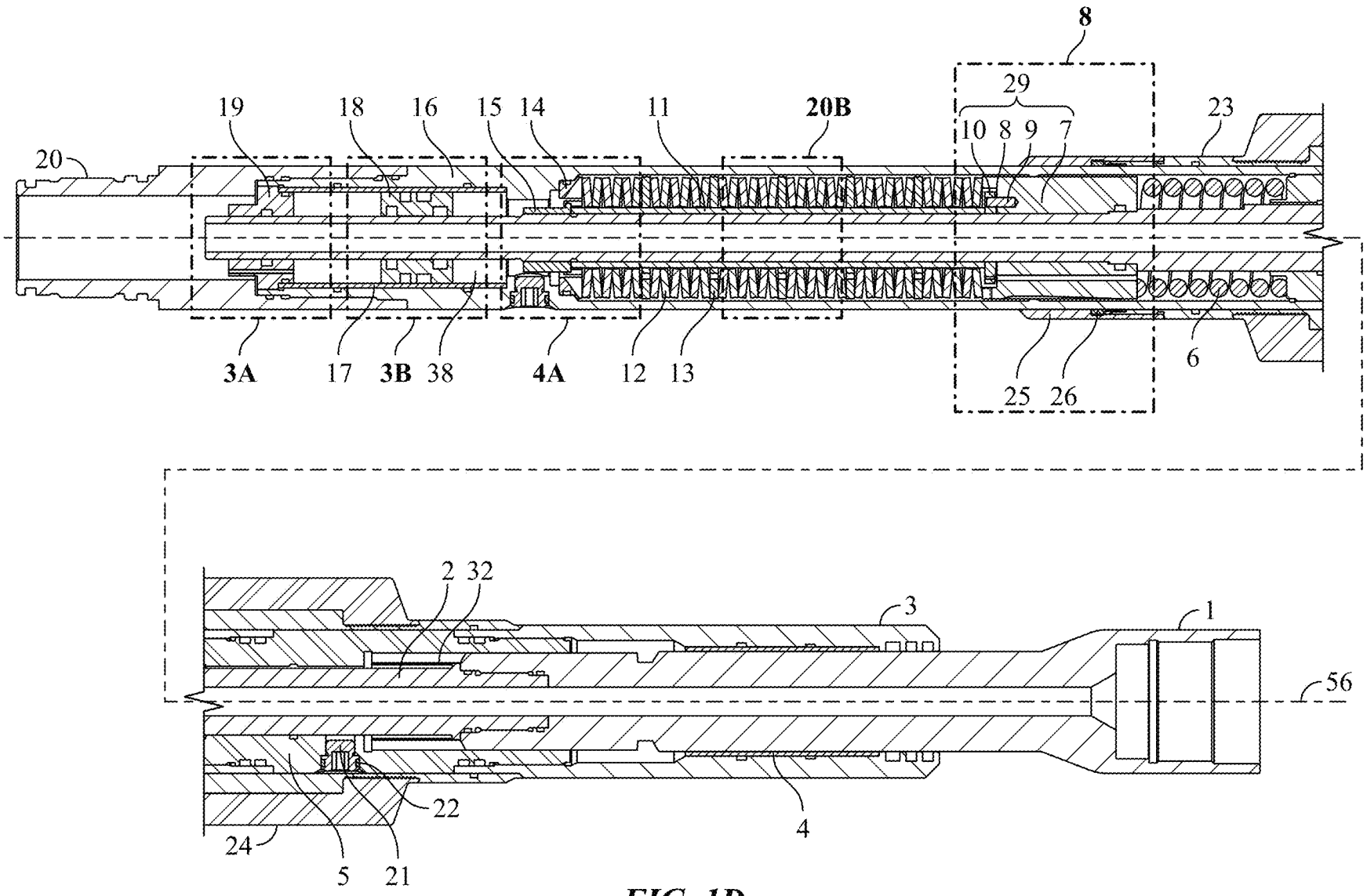
FIG. 1D is an enlarged schematic longitudinal cross-sectional view of the embodiment shown in FIG. 1C.

FIG. 1A is a schematic perspective view of an exemplary embodiment of a shock isolator of the present invention. FIG. 1B is a schematic transverse cross-sectional view of the embodiment shown in FIG. 1A denoting the planes that form the longitudinal cross-sectional view of FIG. 1C. FIG. 1C is a schematic longitudinal cross-sectional view of the embodiment shown in FIG. 1A. FIG. 1D is an enlarged schematic longitudinal cross-sectional view of the embodiment shown in FIG. 1C. A shock isolator 30 is shown in a generally left to right orientation to indicate the standard convention of the uphole portion and "up" direction to the left and the downhole portion and "down" direction to the right. The shock isolator 30 includes a lower mandrel 1 rotatably coupled to an upper mandrel 2, partially covered by a protective end cap 3. A main bearing 4 is disposed between the protective end cap 3 and the lower mandrel 1. The lower mandrel 1 at a distal end from the upper mandrel 2 can be coupled to a downstream component (not shown), including drill pipe or equipment such as drill motors and helix (that is, a pulser lower end).

The shock isolator generally includes a splined bulkhead 5 coupled to the end cap 3. A spline set 32 of an internal spline rotationally coupled with an external spline, preferably an involute spline, rotatably couples the splined bulkhead 5 with the lower mandrel 1. A spring housing 16 is coupled to the splined bulkhead 5. An upper bulkhead 20 is coupled to the spring housing 16. Generally, the splined bulkhead, spring housing, and upper bulkhead form an annulus around the upper mandrel 2 for components described herein for the shock isolator.

A damper piston subassembly 29 can be installed in the annulus of the spring housing against a shoulder of the upper mandrel, forming an annular lower spring chamber 34 between the damper piston subassembly and the splined bulkhead 5, and forming an annular upper spring chamber 36 between an annular flow diverter 14 and the damper piston subassembly. The damper piston subassembly 29 includes a damper piston 7, a unidirectional valve 8, dowel pins 9, and a limit plate 10. The damper piston 7 has a series of internal openings with the unidirectional valve 8 operatively coupled to control flow through the piston openings. The dowel pins 9 can align the unidirectional valve with the piston openings, where the term "dowel pins" is broadly used to include other guides and fasteners that can align the damper piston, unidirectional valve, and limit plate. A limit plate 10 can limit travel of the unidirectional valve away from the piston openings. A plurality of disc springs 12 can be installed in the upper spring chamber 36, which is generally on the compression side of the shock isolator relative to the damper piston. A disk spring guide 11 can be coupled around the upper mandrel 2 radially inward from the disk springs and longitudinally aligned with a portion of the spring housing 16. A spring guide retainer 15 can be coupled to the upper mandrel 2 and restrain the disk spring guide 11 longitudinally on the upper mandrel 2 and thereby restrain the damper piston subassembly 29 longitudinally against the shoulder on the upper mandrel 2. In at least one embodiment, the disk springs 12 can be divided into disk spring stacks that are separated by disks 13, as discussed below, that can be flat, that is, having an external periphery generally parallel to the inner periphery of the disk spring guide 11, the spring housing 16, or both. A rebound spring 6 can be installed in the lower spring chamber 34. The rebound spring 6 can advantageously be a helical coil spring or can be other types of bias elements that can oppose compression of the disk spring and assist in rebound of the shock isolator. The flow diverter 14 can be installed in the upper spring chamber 36 uphole from the disk springs 12 and abutting a shoulder of the spring housing 16. The flow diverter 14 can have one or more openings through which fluid can pass.

The spring housing 16 can also form a compensation chamber 38 uphole from the disk springs 12 and the spring guide retainer 15. The compensation chamber 38 can include a compensation piston liner 17. A compensation piston 18 can be slidably engaged around the upper mandrel 2 and the compensation piston liner 17. A slave damper plate 19 can be coupled to the spring housing 16 in an upper portion of the compensation chamber 38. The slave damper plate 19 can have one or more orifices to form a flow path between the upper portion of the compensation chamber 38 and a volume exposed to ambient conditions external to the shock isolator.

In at least one embodiment, the shock isolator can further provide a centering feature within a drill collar or wellbore during the drilling operation. A centralizer hub 23 can be coupled around the spring housing 16 and formed with one or more centralizer fins 24. A centralizer retainer 25 with a crush washer 26 can be coupled to the centralizer hub 23 around the spring housing 16.

Access to internal volumes of the shock isolator from external surfaces of the shock isolator can be provided such as through an oil plug 21 and other openings. Various seals, such as O-ring 22 and other types of seals, fasteners, threaded connections, and the like can be included in the normal course of design.

Figure 2A:
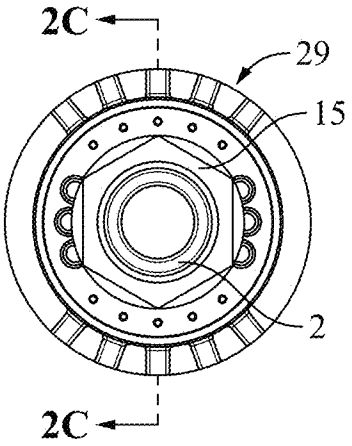
FIG. 2A is a schematic end view of an upper mandrel, damper piston subassembly, disk spring guide, and a spring guide retainer shown in FIG. 1D.
Figure 2B:
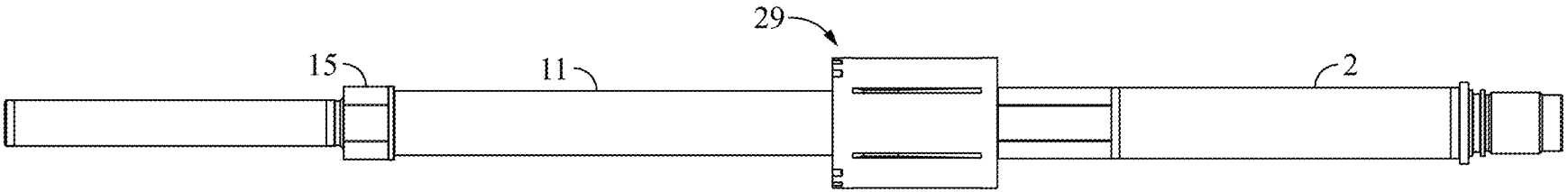
FIG. 2B is a schematic longitudinal side view of the upper mandrel, damper piston subassembly, disk spring guide, and spring guide retainer, shown in FIGS. 1D and 2A.
Figure 2C:
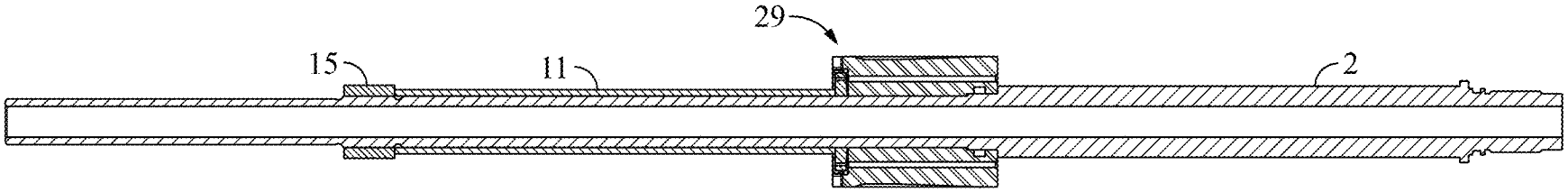
FIG. 2C is a schematic longitudinal cross-sectional view of the upper mandrel, damper piston subassembly, disk spring guide, and spring guide retainer, shown in FIG. 2B.

FIG. 2A is a schematic end view of an upper mandrel, damper piston subassembly, disk spring guide, and a spring guide retainer shown in FIG. 1D. FIG. 2B is a schematic longitudinal side view of the upper mandrel, damper piston subassembly, disk spring guide, and spring guide retainer, shown in FIG. 1C and 2A. FIG. 2C is a schematic longitudinal cross-sectional view of the upper mandrel, damper piston subassembly, disk spring guide, and spring guide retainer, shown in FIG. 2B. The illustrated components represent at least one embodiment of a core with the disk springs and rebound spring (not shown) that can be inserted into the cavity of the end cap 3, splined bulkhead 5, and spring housing 16. The illustrated embodiment includes the upper mandrel 2 with the damper piston subassembly 29 inserted over the mandrel to a shoulder on the mandrel. The disk spring guide 11 can be inserted over the mandrel to the damper piston subassembly, and the spring guide retainer 15 inserted over the mandrel to the disk spring guide, so that the components can be coupled together on the mandrel.

Having described the general structure of the shock isolator 30, further details of features of the shock isolator are described below.

Scalable Back Pressure

Figure 3B:
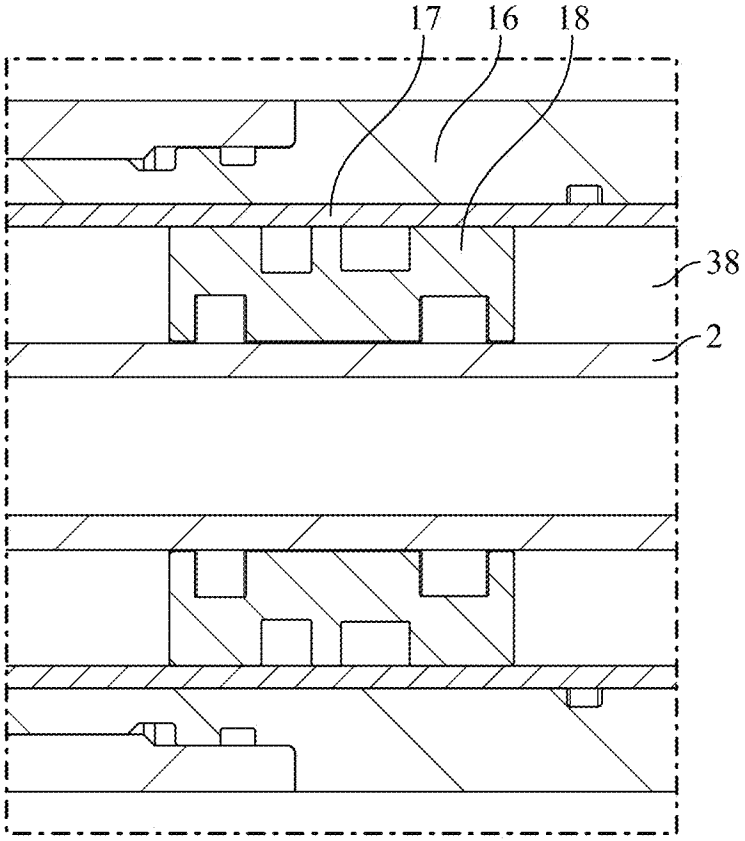
FIG. 3B is an enlarged schematic longitudinal cross-sectional view of a compensation piston shown in FIG. 1D with the compensation piston liner.
Figure 3A:
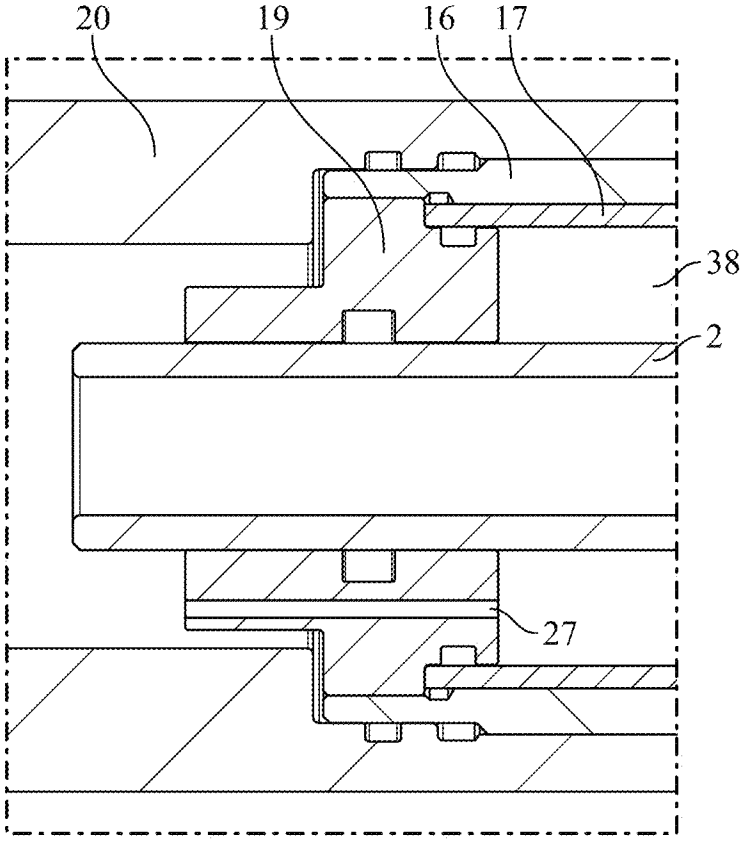
FIG. 3A is an enlarged schematic longitudinal cross-sectional view of a slave damper plate shown in FIG. 1D and a compensation piston liner.
Figure 4A:
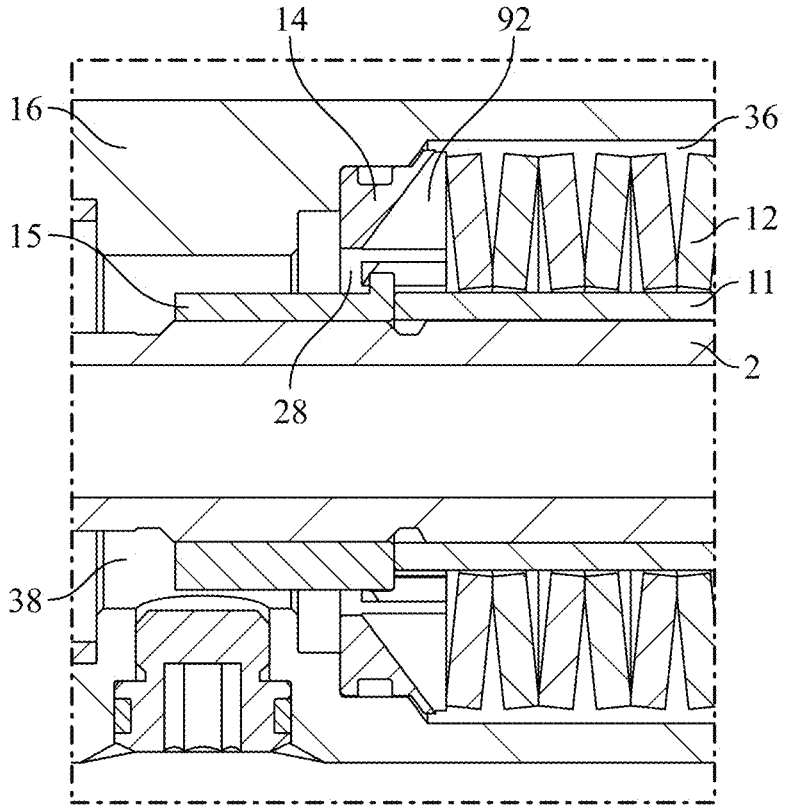
FIG. 4A is a schematic cross-sectional longitudinal view of a spring guide retainer for a disk spring guide having disk springs installed thereon shown in FIG. 1D.
Figure 4B:
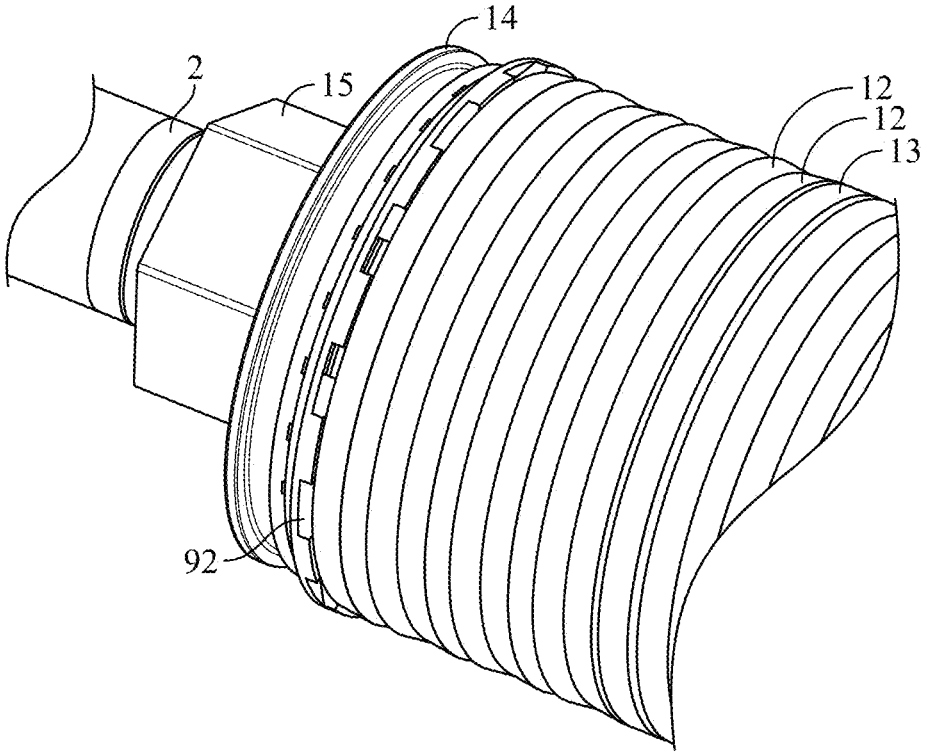
FIG. 4B is a schematic perspective top view of the assembly shown in FIG. 4A with the spring guide retainer, a flow diverter, disk springs, and flat disks.

FIG. 3A is an enlarged schematic longitudinal cross-sectional view of a slave damper plate shown in FIG. 1D and a compensation piston liner. FIG. 3B is an enlarged schematic longitudinal cross-sectional view of a compensation piston shown in FIG. 1D with the compensation piston liner. FIG. 4A is a schematic cross-sectional longitudinal view of a flow diverter and a spring guide retainer for a disk spring guide having disk springs installed thereon shown in FIG. 1D. FIG. 4B is a schematic perspective top view of the assembly shown in FIG. 4A with the flow diverter, spring guide retainer, disk springs, and flat disks.

A feature of the invention is a scalable back pressure on the shock isolator 30. As shown in FIG. 3A, a slave damper plate 19 having a compensation orifice 27 can be coupled in a space between the upper mandrel 2 and the upper bulkhead 20. The compensation orifice 27 is open on an upper end to ambient conditions, such as fluid pressure in the well bore, and open on a lower end to the upper portion of the compensation chamber 38.

As shown in FIG. 3B, a compensator piston 18 is slidably coupled between a compensation piston liner 17 and the upper mandrel 2 and can move by pressure differences between the uphole fluid pressure communicated through the compensation orifice 27 and the fluid pressure in the shock isolator below the compensator piston 18 after regulation by the flow diverter 14 (shown in FIGS. 1C and 1D) of the fluid pressure in the upper spring chamber 36.

As shown in FIGS. 4A and 4B, downhole from the compensator piston 18 is the flow diverter 14 that is located between a shoulder of the spring housing 16 and the disk springs 12 in the upper spring chamber 36. The flow diverter 14 likewise can have a compensation orifice 28 that communicates fluid pressure between the compensation chamber 38 below the compensation piston 18 and the upper spring chamber 36. These three sets of sequential hydraulic orifices (orifices 27, 28 and 42 described below) form a multi-stage hydraulic damping system, which can generate very high hydraulic back pressure (differential). Flow diverter port 92 regulates the hydraulic flow and back pressure generated in the upper spring chamber 36 during a compression stroke. Proper sizing of each of the three sequential hydraulic orifices can render and control the hydraulic back pressure differential profile along the whole system.

Unidirectional Flow Valve for Piston Openings

Figure 5A:
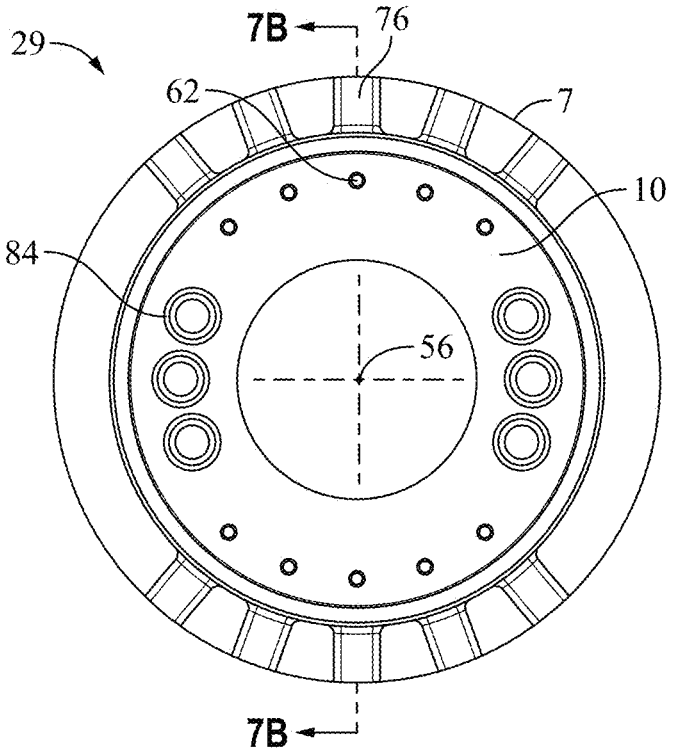
FIG. 5A is a schematic end view of the damper piston subassembly, having a limit plate, flow slots, bidirectional variable metered hydraulic damping orifices and unidirectional pedal valve to unidirectionally close flow through one or more piston openings.
Figure 5B:
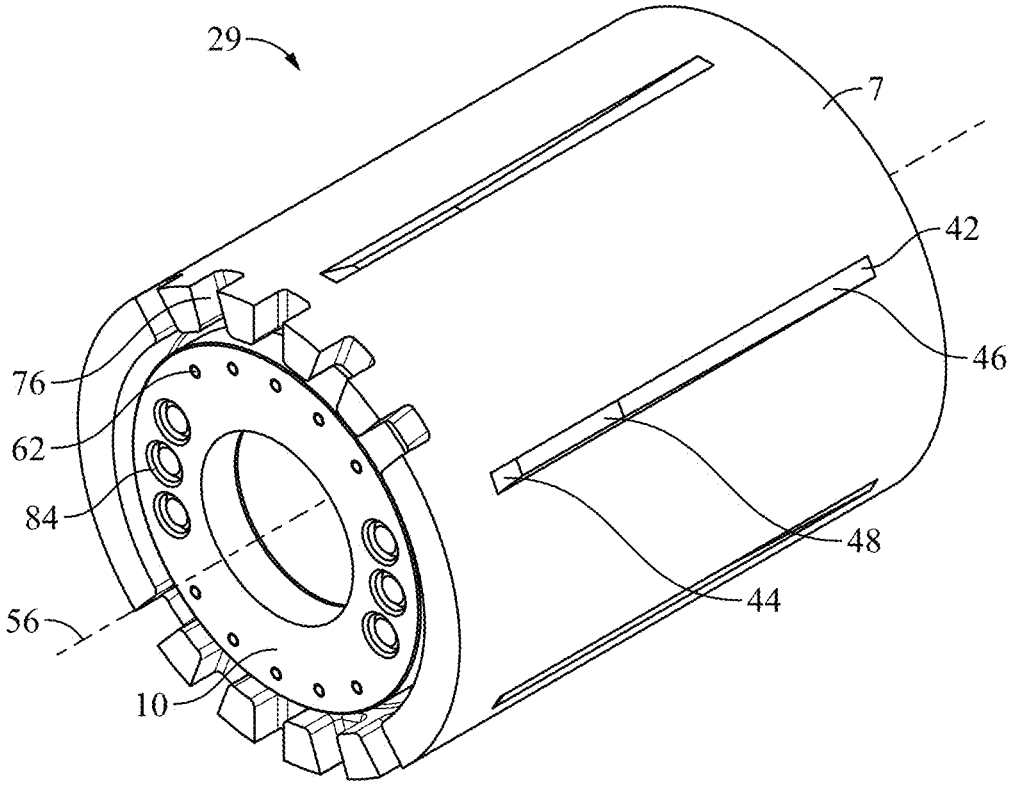
FIG. 5B is a schematic perspective top view of the damper piston subassembly shown in FIG. 5A.
Figure 6:
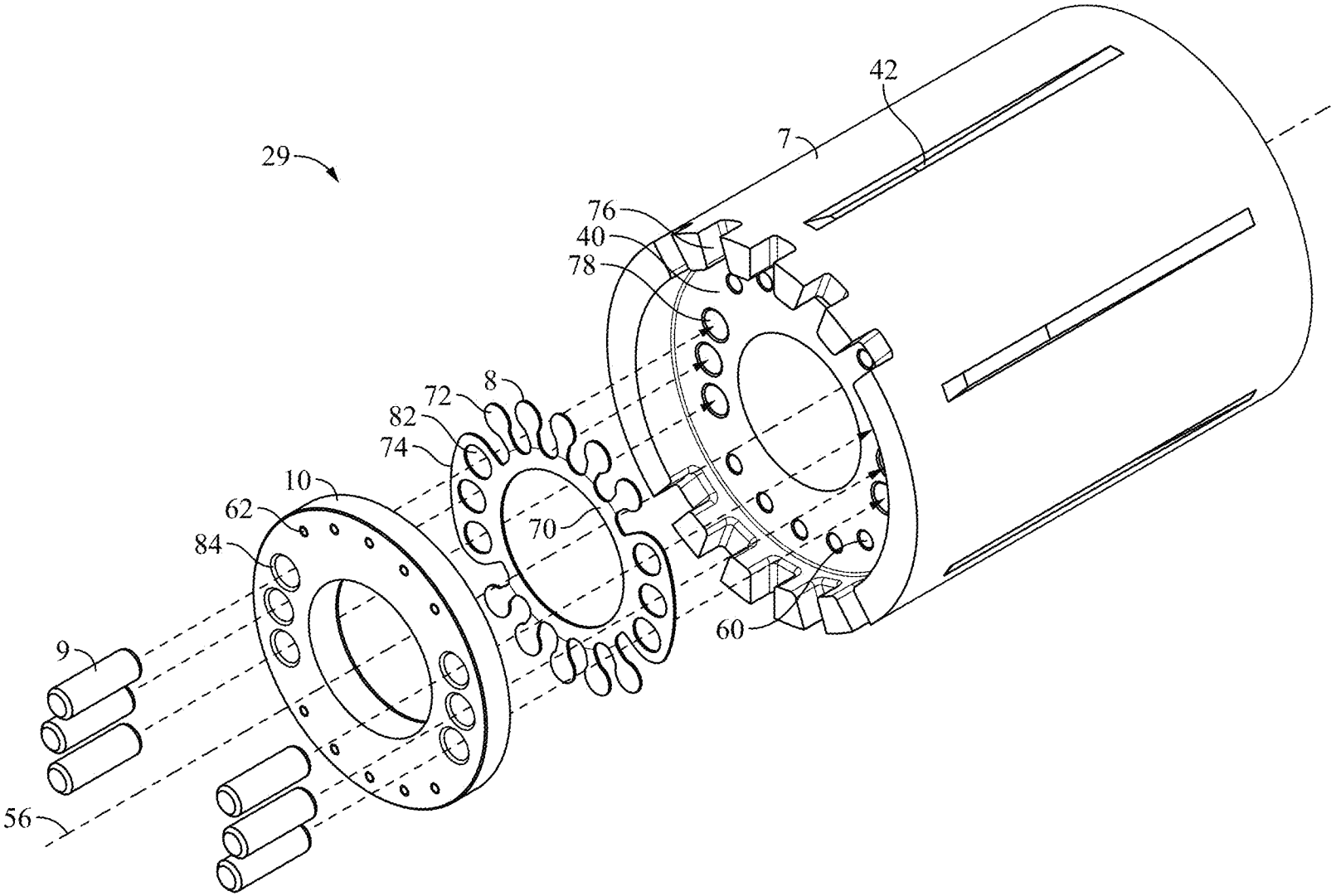
FIG. 6 is a schematic exploded perspective view of the damper piston subassembly shown in FIG. 5A.
Figure 7A:
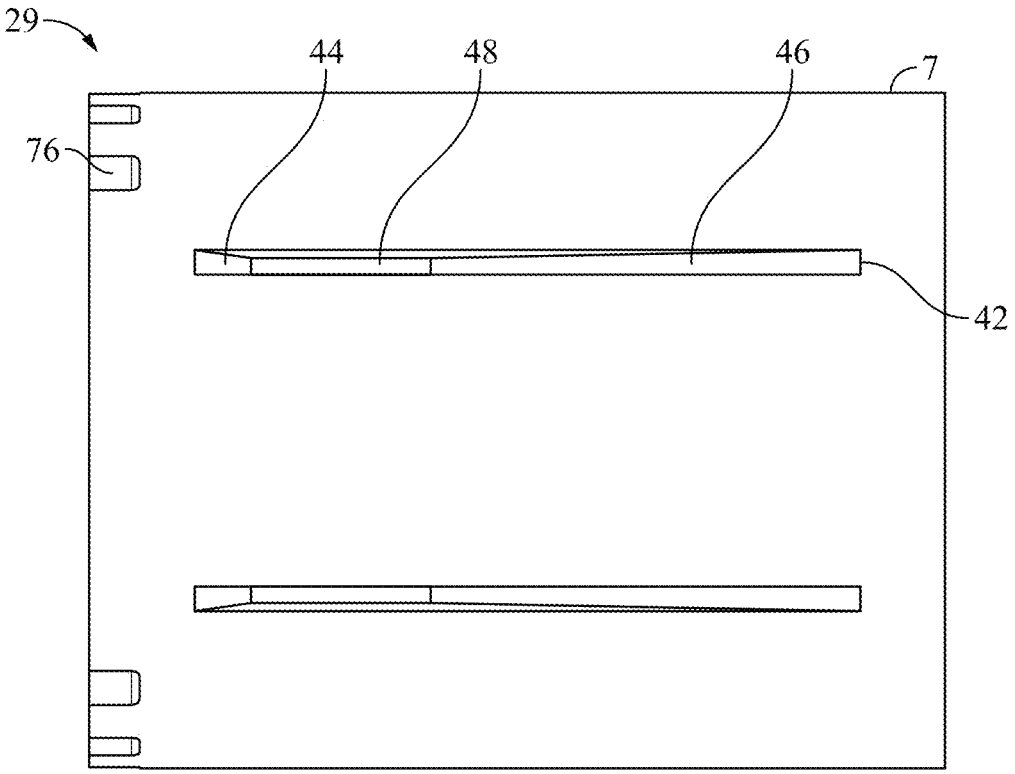
FIG. 7A is a schematic longitudinal view of the damper piston subassembly.
Figure 7B:
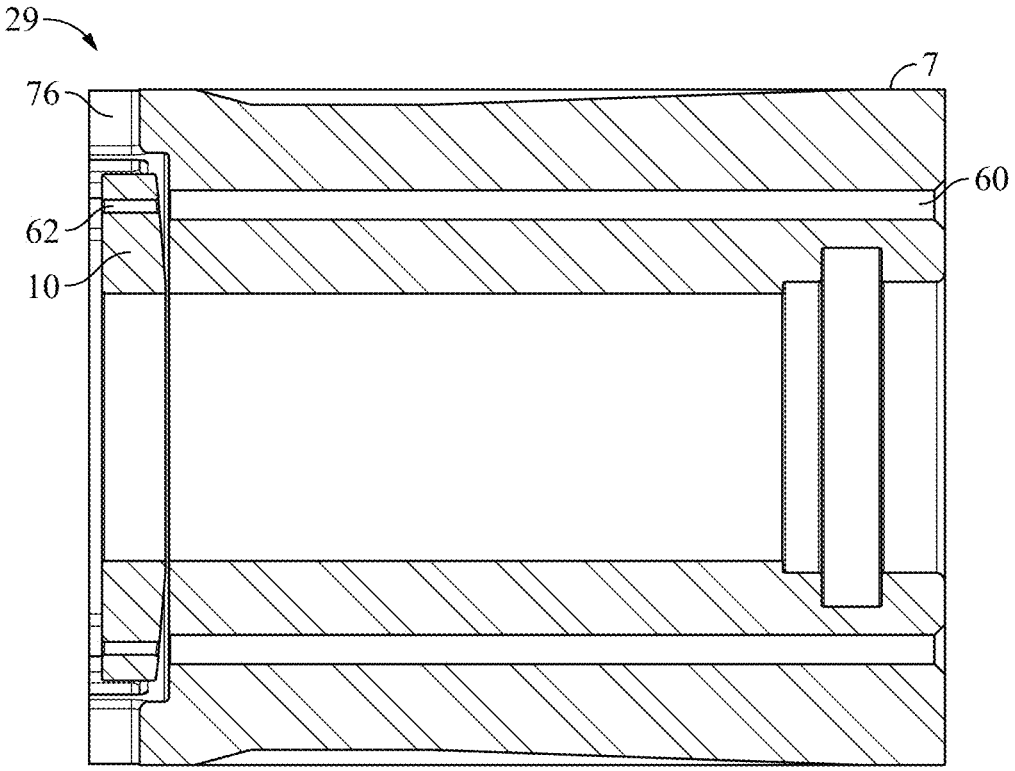
FIG. 7B is a schematic longitudinal cross-sectional view of the damper piston subassembly, shown in FIGS. 5A and 7A.
Figure 8:
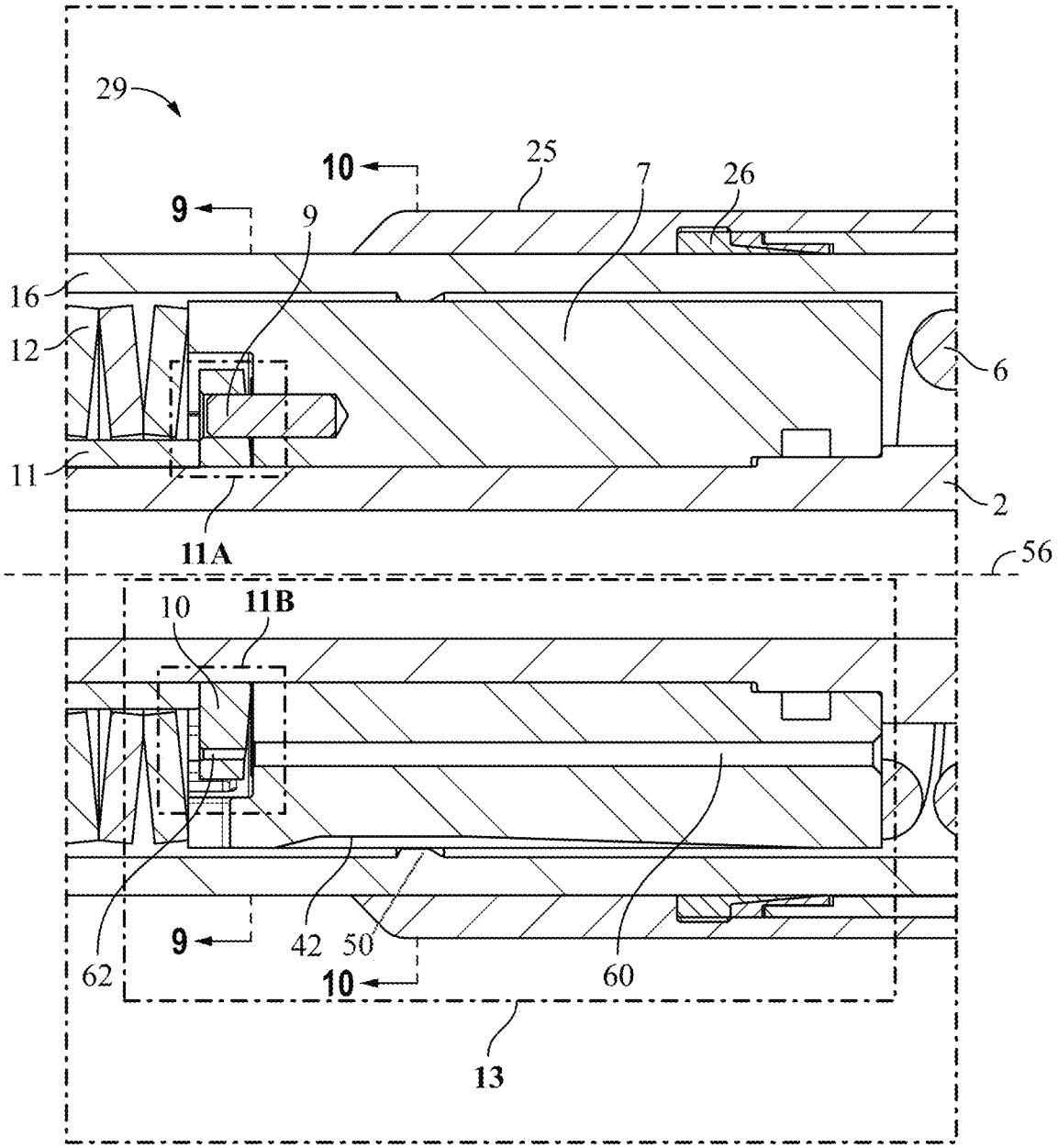
FIG. 8 is a schematic longitudinal cross-sectional view of the damper piston subassembly installed on the upper mandrel, shown in FIG. 1D.
Figure 10:
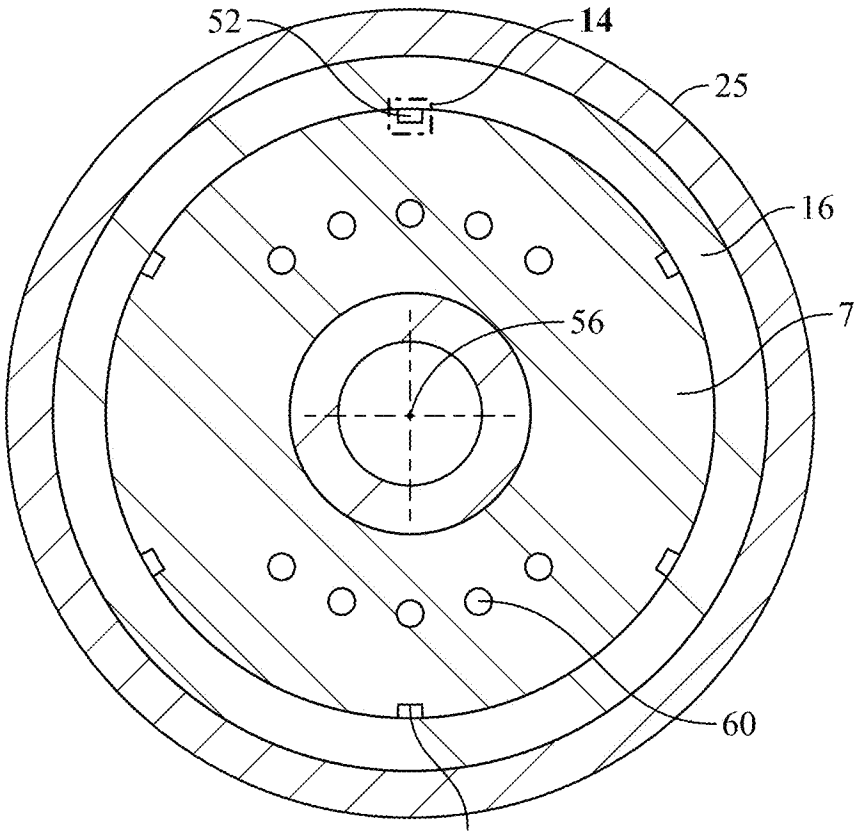
FIG. 10 is a schematic transverse cross-sectional view of the damper piston shown in FIG. 8, showing the damper piston openings to interface with the unidirectional valve and bidirectional variable metered hydraulic damping orifices.
Figure 9:
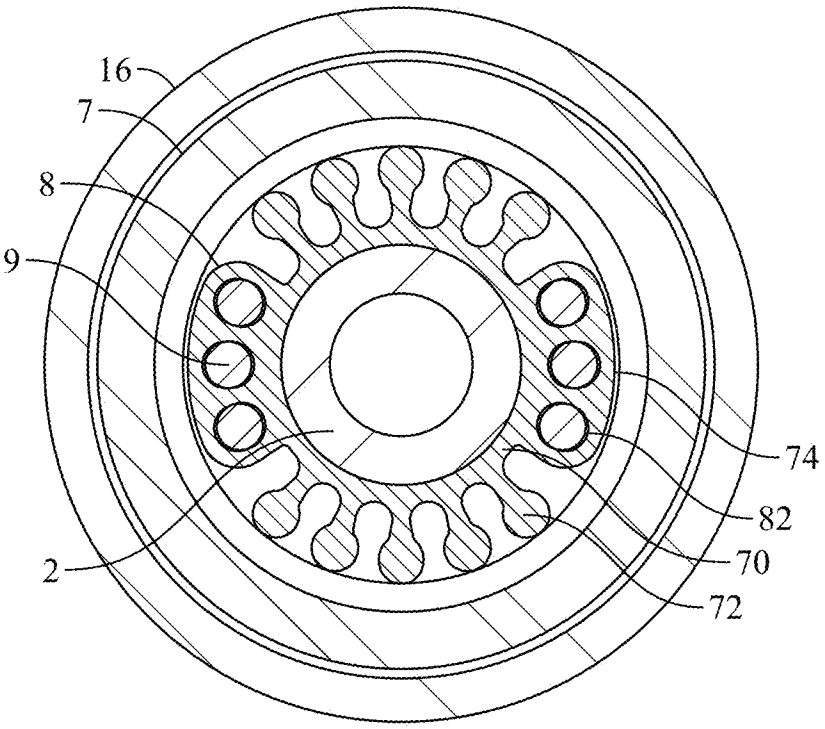
FIG. 9 is a schematic transverse cross-sectional view of the damper piston subassembly shown in FIG. 8, illustrating a unidirectional valve installed to directionally seal damper piston openings.
Figure 11A:
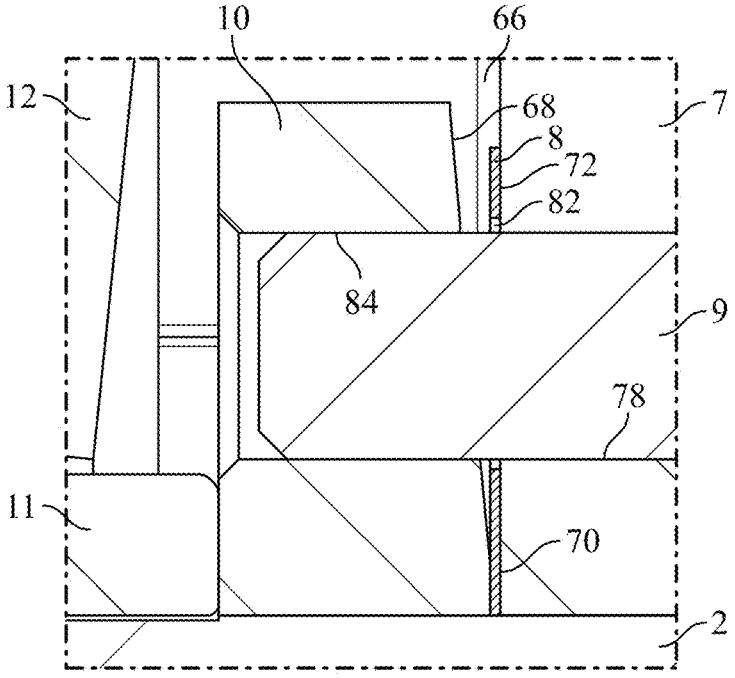
FIG. 11A is a schematic longitudinal cross-sectional view of a portion of the damper piston subassembly shown in FIG. 8, having a unidirectional valve, a locating pin installed in the damper piston for alignment of the unidirectional valve to the damper piston, and a unidirectional valve plate aligned with the pin.
Figure 11B:
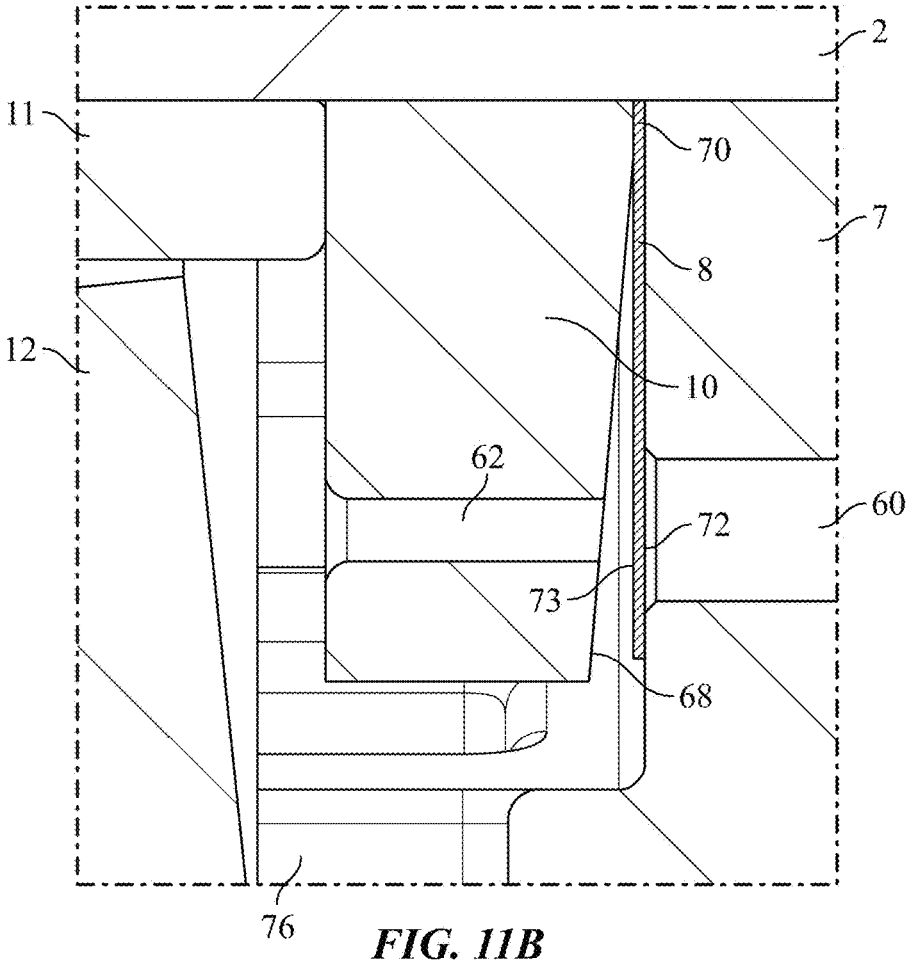
FIG. 11B is a schematic longitudinal cross-sectional view of a portion of the damper piston subassembly shown in FIG. 8, having a damper piston opening with a unidirectional valve sealing an end of the damper piston opening, a unidirectional valve plate having a relief opening aligned with the damper piston opening.
Figure 12A:
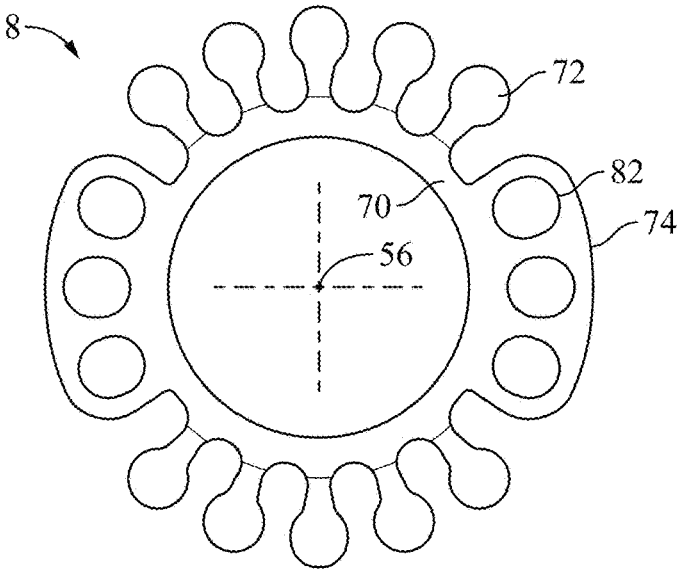
FIG. 12A is a schematic front view of an illustrative embodiment of the unidirectional valve, formed as a petal valve, for the damper piston openings.
Figure 12B:
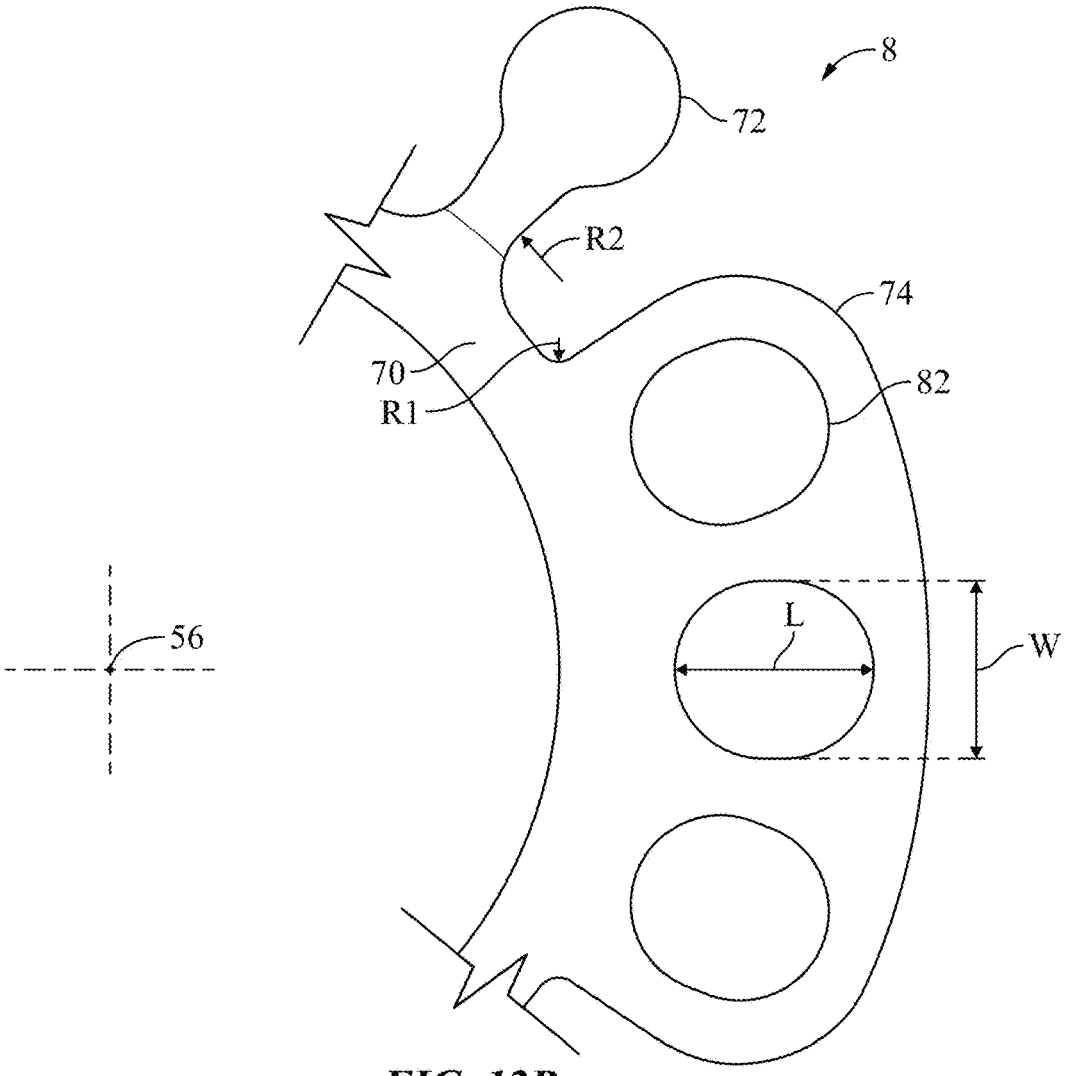
FIG. 12B is a schematic enlarged front view of a portion of the unidirectional valve shown in FIG. 12A.

FIG. 5A is a schematic end view of the damper piston subassembly, having a limit plate, flow slots, bidirectional variable metered hydraulic damping orifices and unidirectional pedal valve to unidirectionally close flow through one or more piston openings 60. FIG. 5B is a schematic perspective top view of the damper piston subassembly shown in FIG. 5A. FIG. 6 is a schematic exploded perspective view of the damper piston subassembly shown in FIG. 5A. FIG. 7A is a schematic longitudinal view of the damper piston subassembly. FIG. 7B is a schematic longitudinal cross-sectional view of the damper piston subassembly, shown in FIGS. 5A and 7A. FIG. 8 is a schematic longitudinal cross-sectional view of the damper piston subassembly installed on the upper mandrel, shown in FIG. 1D. FIG. 9 is a schematic transverse cross-sectional view of the damper piston subassembly shown in FIG. 8, illustrating a unidirectional valve installed to directionally seal damper piston openings. FIG. 10 is a schematic transverse cross-sectional view of the damper piston shown in FIG. 8, showing the damper piston openings to interface with the unidirectional valve and bidirectional variable metered hydraulic damping orifices. FIG. 11A is a schematic longitudinal cross-sectional view of a portion of the damper piston subassembly shown in FIG. 8 having a unidirectional valve, a locating pin installed in the damper piston for alignment of the unidirectional valve to the damper piston, and a unidirectional valve plate aligned with the pin. FIG. 11B is a schematic longitudinal cross-sectional view of a portion of the damper piston subassembly shown in FIG. 8 having a damper piston opening with a unidirectional valve sealing an end of the damper piston opening, a unidirectional valve plate having a relief opening aligned with the damper piston opening. FIG. 12A is a schematic front view of an illustrative embodiment of the unidirectional valve, formed as a petal valve, for the damper piston openings 60. FIG. 12B is a schematic enlarged front view of a portion of the unidirectional valve shown in FIG. 12A.

Another feature of the invention includes a unidirectional valve 8 for unidirectional sealing one or more piston openings 60 in the damper piston 7 of the damper piston subassembly 29. The damper piston subassembly 29 is located on the upper mandrel 2 in the shock isolator between the rebound spring 6 and the disk spring 12. The damper piston 7 can include one or more piston openings 60 longitudinally formed through the body of the damper piston, that is, radially inward of the outer periphery of the damper piston. In at least one embodiment, a plurality of piston openings 60 can be formed at a plurality of radial angles around a longitudinal axis 56 of the damper piston, such as shown in FIG. 10. In at least one embodiment, the unidirectional valve 8 can have a hub portion 70 coupled to the face 40 radially distal from the piston openings 60 and a sealing portion 72 flexibly coupled over an end of the piston openings 60 across the face 40 of the damper piston. Further, the unidirectional valve 8 can include a valve alignment portion 74 having at least one pin opening 82 to align with a fastener 9 in the damper piston pin opening 78 to align the unidirectional sealing portions with the piston openings 60.

The unidirectional valve 8 is configured to bend away from the face 40 and allow flow through the piston openings in a first flow direction and longitudinally close over the face to restrict flow in a second flow direction to control a damping and response time of the shock isolator to reciprocal compression and return. In the embodiment shown, the first flow direction in which the piston openings 60 are uncovered by the valve can allow an uphole direction of fluid flow through the opening and then optionally radially outward through flow slots 76 and uphole from the front face of the damper piston 7. The second flow direction in which the piston openings are covered by the unidirectional valve 8 can be a downhole direction of fluid flow that is blocked by the unidirectional valve. The unidirectional valve 8 can be moved away from the piston openings 60 by the fluid flow in the first flow direction to open flow through the openings. The unidirectional valve 8 can be biased to cover the piston opening 60 at rest and in the second flow direction, such as shown in FIG. 9 and FIG. 11B below. One or more fasteners 9, such as dowel pins, can be disposed in the damper piston in openings 78 to align the unidirectional valve with the piston openings 60.

Referring to FIGS. 11A-12B, the unidirectional valve 8 can be designed to allow flexibility for uncovering the piston opening 60. When the opening is uncovered, fluid can flow through the opening past the unidirectional valve sealing portion by cantilever movement of a sealing portion 72 away from the piston opening 60 without significant movement of the coupled hub portion 70 and without overstressing the materials of the valve. To assist in reducing stresses, a transition between the hub portion 70 and the alignment portion 74 can have a radius R1, while a transition between the hub portion 70 and the sealing portion 72 can have a radius R2 that is larger than R1 due to the increased bending of the sealing portion 72. Further, the pin opening 82 in the unidirectional valve 8 can be designed with asymmetrical clearance of the opening for the fastener 9. In at least one embodiment, the pin opening 82 can be designed with a longer length L than its width W to establish a major axis of the pin opening with clearance in line with the major axis. The pin opening 82 can be located so that its major axis is substantially radially aligned with the longitudinal axis 56. The clearance from the longer length L in the pin opening allows flexing of the alignment portion 74 radially as the sealing portion 72 flexes with the hub portion 70 and the alignment portion 74 in a radially aligned direction.

A limit plate 10 can be coupled to the damper piston 7 and aligned with the fasteners 9 through an opening 84 in the limit plate. The unidirectional valve 8 can be disposed between the limit plate 10 and the damper piston face 40, so that the limit plate restricts bending of the valve 8 and therefore opening of the valve to within a valve travel space 66. The valve travel space 66 can be formed with a tapered face 68 of the limit plate, also shown in FIGS. 11A and 11B. The face 68 of the limit plate has a taper that longitudinally progressively increases the travel space 66 as a distance from the hub portion 70 to the sealing portion 72 increases, as illustrated particularly in FIGS. 11A and 11B. The term "taper" or "tapered" is used broadly herein and includes linear and curved surfaces. The tapered face 68 can extend radially inward past the fastener 9 to a hub section 70 of the unidirectional valve 8.

A backside 73 of the sealing portion 72 of the unidirectional valve 8 (that is, an opposite side from the sealing side adjacent the piston opening 60) may become temporarily coupled to the tapered face 68 of the limit plate 10 due to vacuum created in the flow through the openings 60 on the damper piston. A relief opening 62 formed in the limit plate 10 can release vacuum on the backside 73 from the tapered surface of the limit plate 10 after flow through the piston opening 60 and allow the sealing portion 72 to return to cover and seal across the piston opening 60.

One or more bidirectional, variable metered, hydraulic damping orifices 42 can generally be created in an outer periphery of the damper piston 7 to interface with a surrounding spring housing 16 of the shock isolator, as shown in FIGS. 1A-1C and FIG. 8. The damping orifices 42 can be formed as slots in the outer periphery of the damper piston and can have portions with various shapes and depths to tune the response of the shock isolator by controlling fluid flow around the damper piston through the damping orifices. In at least one embodiment, the damping orifices 42 can include an uphole taper 44, a downhole taper 46, and a cylindrical portion 48 longitudinally disposed between the uphole and downhole tapers. Further, the uphole taper can be tapered differently than the downhole taper to create different responses of the shock isolator in an upstroke and downstroke cycle during operation.

Bidirectional Variable Metered Hydraulic Damping Orifice

Figure 13:
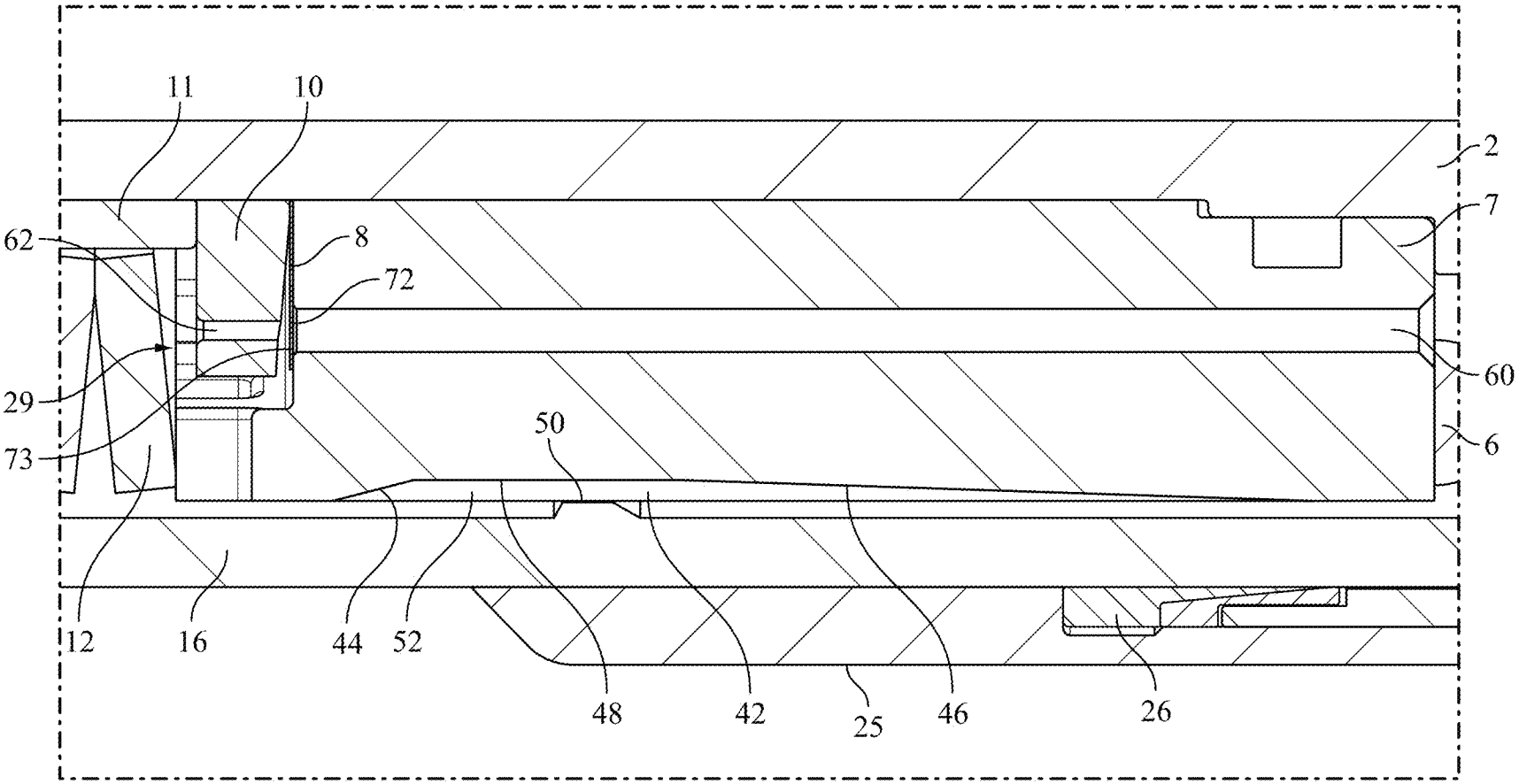
FIG. 13 is a schematic longitudinal cross-sectional view of a portion of the damper piston, showing the bidirectional variable metered hydraulic damping orifice shown in FIGS. 7A and 8.
Figure 14:
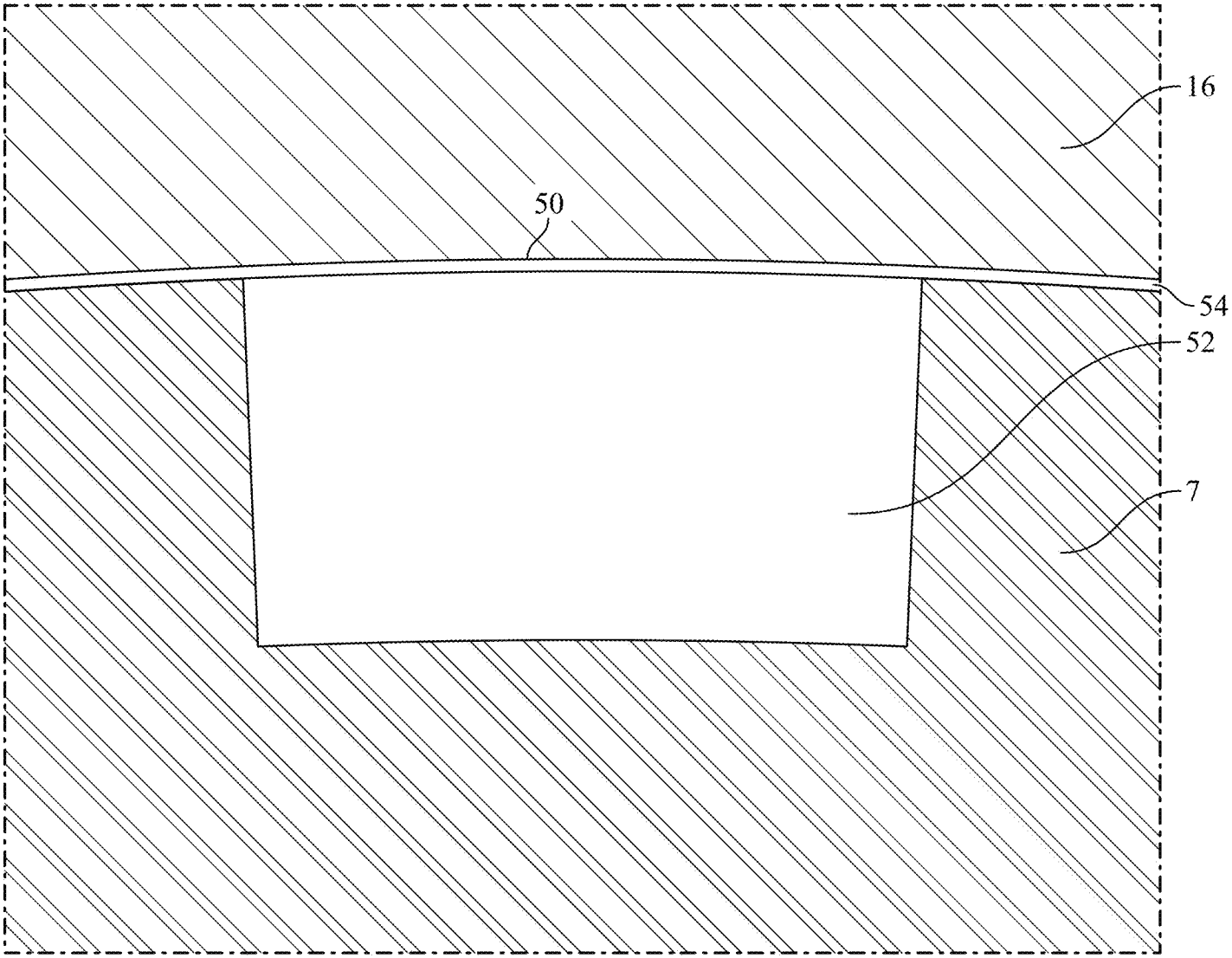
FIG. 14 is a schematic enlarged transverse cross-sectional view (identified in FIG. 10 that is orthogonal to the cross-section of FIG. 13) of a flow zone of the bidirectional variable metered hydraulic damping orifice and an annular flow orifice.

FIG. 13 is a schematic longitudinal cross-sectional view of a portion of the damper piston, showing the bidirectional variable metered hydraulic damping orifice shown in FIGS. 7A and 8. FIG. 14 is a schematic enlarged transverse cross-sectional view (identified in FIG. 10 that is orthogonal to the cross-section of FIG. 13) of a flow zone of the bidirectional variable metered hydraulic damping orifice and an annular flow orifice. As described above, the damper piston subassembly 29 with the damper piston 7 is located inside the spring housing 16 between the rebound spring and the disk springs. A spring housing seat 50 of the spring housing extends radially inwardly toward an outer periphery of the damper piston subassembly 29 to form a restrictive fluid flow passage. The restrictive fluid flow passage can be used to control the damping and response time of the shock isolator.

A feature of the invention includes a bidirectional variable metered hydraulic damping orifice 42 as one of the above restrictive flow passages. The bidirectional variable metered hydraulic damping orifice 42 is formed on an outer periphery of the damper piston 7. The damping orifice 42 has an uphole taper 44 on a first end of the orifice, a downhole taper 46 on a second end of the orifice, and a cylindrical portion 48 between the uphole and downhole tapers. As mentioned above, the term "taper" or "tapered" is used broadly herein and includes linear and curved surfaces. The damping orifice 42 forms a flow zone 52 between an inner periphery of the spring housing 16 having a spring housing seat 50 and an outer periphery of the damper piston 7. As the shock isolator reacts to different shocks to compress the springs and allow rebound of the springs, the damper piston subassembly 29 can move longitudinally relative to the spring housing 16. As the damper piston subassembly 29 moves longitudinally, the flow area 52 in the damper piston 7 varies in cross-section depending on the longitudinal location of the damper piston relative to a circumferential spring housing seat 50 on the inner periphery of the spring housing 16. In this embodiment as an example, the uphole taper 44 with a steeper incline narrows the flow zone 52 at a faster rate for a given longitudinal increment than the downhole taper 46. Thus, the rate of change of a response time of the shock isolator is different on the compression stroke compared to the rebound stroke of a cycle. The cylindrical portion 48 is generally not tapered to provide a constant flow zone cross-sectional area and allow some inertial variation in the longitudinal location of the damper piston subassembly 29 when the shock isolator is at a rest position. The primary damping action can be considered inertial damping of a turbulent flow regime through the orifice 42.

A second restrictive flow passage includes an annular orifice 54 formed between an inner periphery of the spring housing seat 50 and an outer periphery of the damper piston 7. The clearance between those surfaces (other than the damping orifice 42) forms the annular orifice 54. The amount of flow and therefore damping action in the annular orifice 54 is determined by the amount of clearance. The annular orifice 54 can be considered viscous damping of a laminar flow regime as a secondary damping action.

Involute Spline Set

Figure 15A:
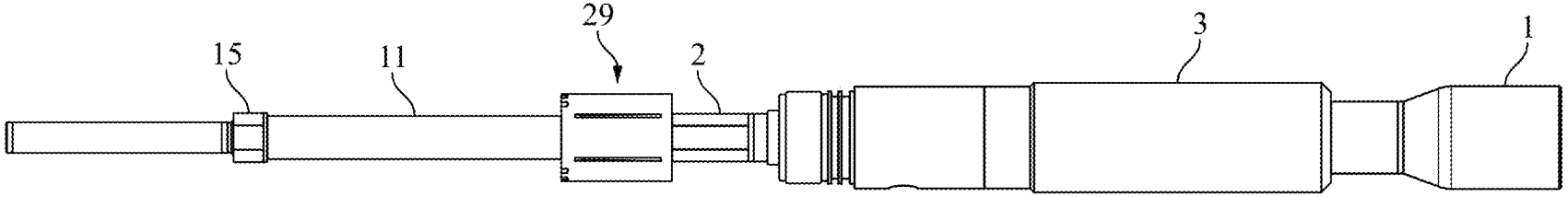
FIG. 15A is a schematic longitudinal view of a lower mandrel coupled with an upper mandrel with an end cap covering a portion of the mandrels and further showing the damper piston, disk spring guide, and a spring guide retainer.
Figure 15B:
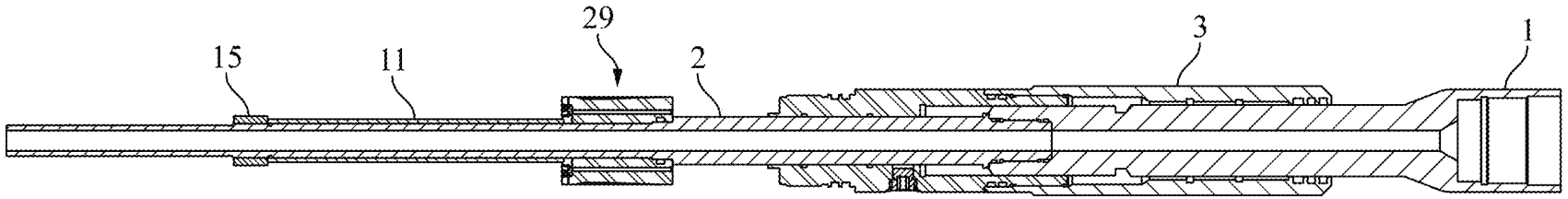
FIG. 15B is a schematic longitudinal cross-sectional view of the assembly of FIG. 15A.
Figure 16:
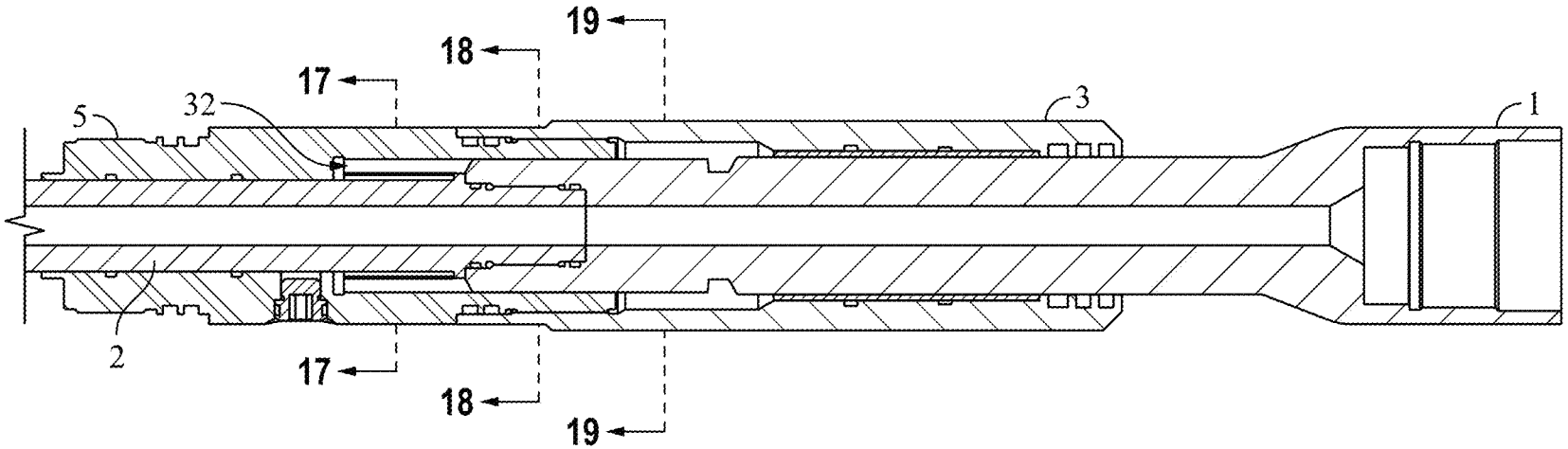
FIG. 16 is a schematic enlarged longitudinal cross-sectional view of the lower mandrel coupled with the upper mandrel with the end cap covering a portion of the mandrels, shown in FIG. 15B.
Figure 19:
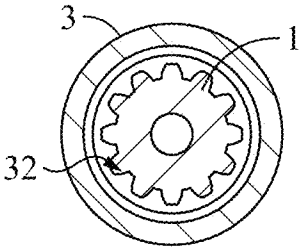
FIG. 19 is a schematic transverse cross-sectional view of an end cap coupled with the lower mandrel having splines, shown in FIGS. 1D and 16.
Figure 18:
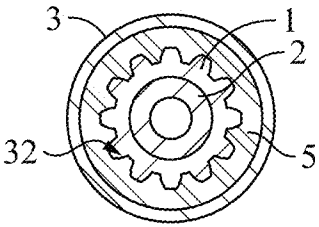
FIG. 18 is a schematic transverse cross-sectional view of an end cap, splined bulkhead, lower mandrel, and upper mandrel, shown in FIGS. 1D and 16.
Figure 17:
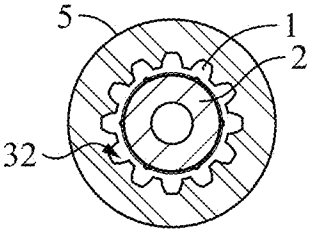
FIG. 17 is a schematic transverse cross-sectional view of a splined bulkhead having internal splines to couple with the lower mandrel having corresponding external splines and the lower mandrel coupled to the upper mandrel shown in FIGS. 1D and 16.

FIG. 15A is a schematic longitudinal view of a lower mandrel coupled with an upper mandrel with an end cap covering a portion of the mandrels and further showing the damper piston, disk spring guide, and a spring guide retainer. FIG. 15B is a schematic longitudinal cross-sectional view of the assembly of FIG. 15A. FIG. 16 is a schematic enlarged longitudinal cross-sectional view of the lower mandrel coupled with a portion of the upper mandrel with the end cap covering a portion of the mandrels, shown in FIG. 15B. FIG. 17 is a schematic transverse cross-sectional view of a splined bulkhead having internal splines to couple with the lower mandrel having corresponding external splines (together, a spline set) and the lower mandrel rotationally coupled to the upper mandrel shown in FIGS. 1D and 16. FIG. 18 is a schematic transverse cross-sectional view of an end cap, splined bulkhead, lower mandrel, and upper mandrel, shown in FIGS. 1D and 16. FIG. 19 is a schematic transverse cross-sectional view of an end cap coupled with the lower mandrel having external splines, shown in FIGS. 1D and 16.

A further feature of the invention is an involute spline set having an internal spline and an external spline for rotationally coupling high torque components together. The lower mandrel 1 is a core portion of the shock isolator that is used to interact with the downstream of the shock isolator. An involute spline set 32 having an external spline can be provided to a remainder of the lower mandrel, either integrally formed with or as a separate component connected to the remainder. The external spline on the lower mandrel in this embodiment can engage a corresponding internal spline of the involute spline set 32 on the splined bulkhead 5 that is rotationally coupled to the housing, so that the lower and upper mandrels are rotationally coupled to the housing. Torque can be transferred from a pulser tool or a drill string downhole of the shock isolator to a drill string or other components uphole of the shock isolator, or vice versa.

Traditionally, shock isolators use a square or rectangular spline with ostensibly increased surface area to promote longevity in the wellbore operation. Surprisingly, the inventors have departed from traditional reasoning and found that an involute spline can transfer either greater torque for a same operational condition, or the same torque for a greater operational time, or a combination thereof compared to the typical shock isolators with the square or rectangular splines. An involute spline is a spline with involute tooth having a maximum strength at the base, can be accurately spaced, and are self-centering and so equalize bearing forces on the mating spline to help equalize the associated stresses.

Stacks of Disk Springs Separated by Flat Washers with Hydraulic Relief Openings

Figure 20A:
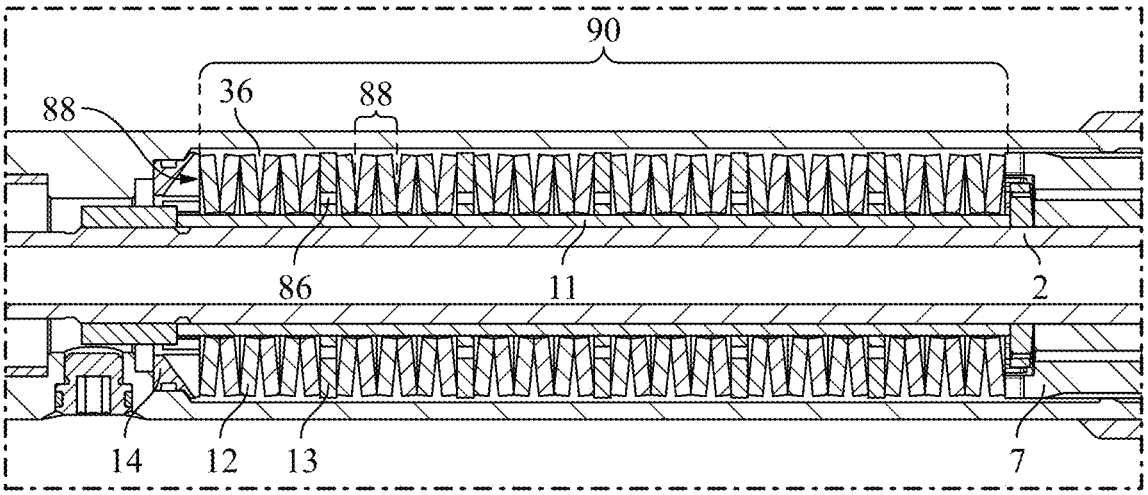
FIG. 20A is a schematic longitudinal cross-sectional view of a disk spring assembly having constant spring constants separated in stacks.
Figure 20B:
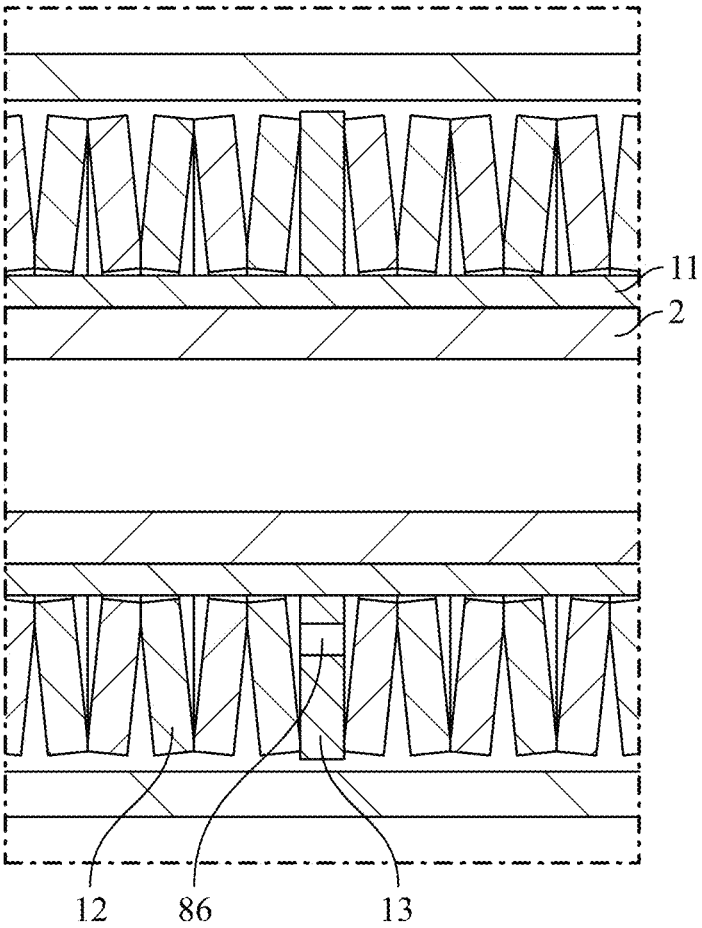
FIG. 20B is a schematic enlarged longitudinal cross-sectional view of a disk spring assembly shown in FIG. 1D having a flat disk between disk spring stacks with a hydraulic flow opening.

FIG. 20A is a schematic longitudinal cross-sectional view of a disk spring assembly having constant spring constants separated in stacks. FIG. 20B is a schematic enlarged longitudinal cross-sectional view of a disk spring assembly shown in FIG. 1D having a flat disk between disk spring stacks with a hydraulic flow opening.

In this embodiment, the disk springs 12 can have uniform spring constants in the stacks 88. Each spring stack 88 can be separated from an adjacent spring stack by a flat disk 13. The flat disk 13 functions to allow the stacks 88 of disk springs to more readily move longitudinally along the surface of the disk spring guide 11 by offering a parallel surface to slide rather than an angled surface of the disk springs that tends to grip the slidable surface and resist movement.

Further, it has been found that an advantageous number of disk springs per stack can vary from 2 to 10 of the same spring constant in a stack. A set of a plurality of stacks departs from a typical disk spring assembly that includes just one assembly of disk springs of possibly 20 to 40 or more disks springs without dividers of flat disks.

In at least one embodiment, the flat disk 13 can include at least one disk orifice 86 through which fluid in at least the upper spring chamber 36 having the disk springs 12 can readily flow across disk spring stacks when the chamber is compressed, and when the chamber is again allowed to extend. The ready ability to flow helps equalize the pressures between the stacks and throughout the upper spring chamber, and indirectly can affect the lower spring chamber described herein in a like manner.

Arranging Disk Spring Stacks Having Progressive Spring Constants

Figure 21:
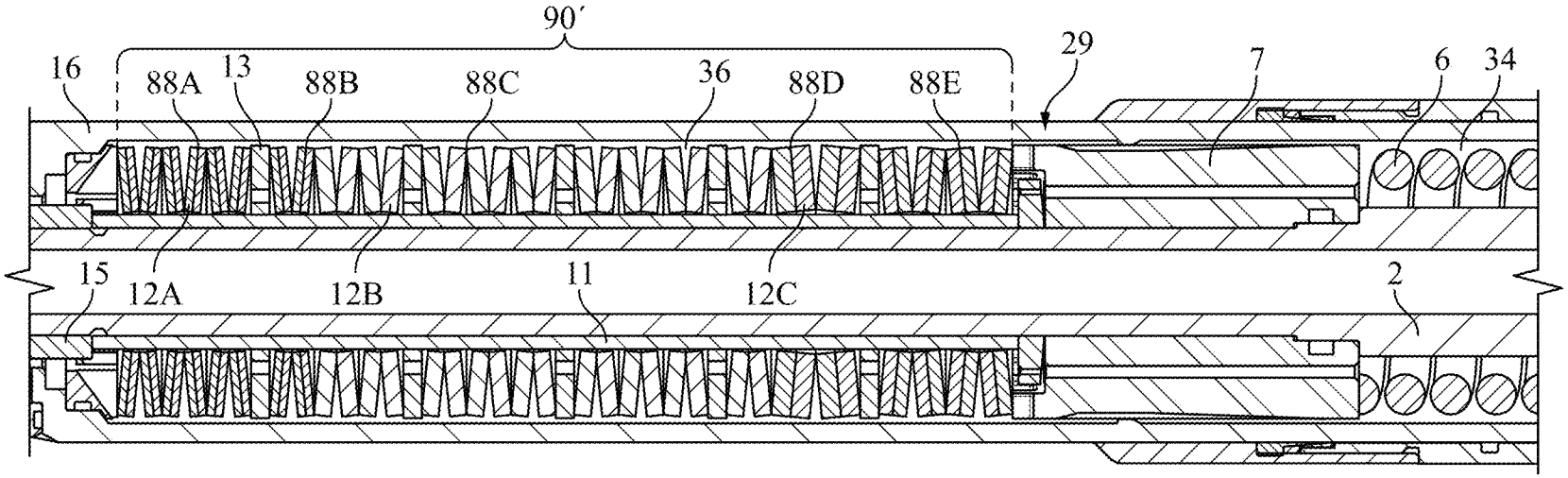
FIG. 21 is a schematic longitudinal cross-sectional view of a disk spring assembly of disk spring stacks having progressive spring constants.

FIG. 21 is a schematic longitudinal cross-sectional view of a disk spring assembly of disk spring stacks having progressive spring constants.

Another feature of the invention is varying the spring constant disk springs. Traditionally, disk springs in at least shock isolators have uniform spring constants in one assembly of springs. However, it has been found that disk springs proximal to a moving load encounter higher stress loads than distal disk springs further away from the moving load. The disproportionate heavy stress load on the proximal disk springs causes a premature failure of the shock isolator, and the premature need to rebuild with replacement components.

The invention departs from accepting the typical varying stress levels by arranging disk springs 12 with progressive spring constants. The effect is to more evenly distribute the stress along the length of a disc springs assembly 90' and increase longevity of the shock isolator. The disk springs 12 can be separated into stacks 88A-88E (generally "88") with a flat disk 13 inserted between the stacks. For example, stack 88A can have a lower overall spring constant than stack 88B that can have a lower overall spring constant than stack 88C and so forth for stacks 88D and 88E in the illustrated nonlimiting embodiment of FIG. 21. The spring constants of a particular stack can be caused by different disk springs, such as different cross sections of the disk springs, such as disk springs 12A, 12B and 12C, different metallurgical properties and heat treatment, and different configurations and combinations of disk springs in the particular stack.

The flat disk 13 also functions to allow the stacks 88 of disk springs to more readily move along the surface of the disk spring guide 11 by offering a parallel surface to slide rather than an angled surface of the disk springs that tends to grip the slidable surface and resist movement. While not shown, the flat disks can also have the disk orifice, described above.

Helical Spring Balancing Disk Springs in Two Phases of a Stroke

Figure 22:
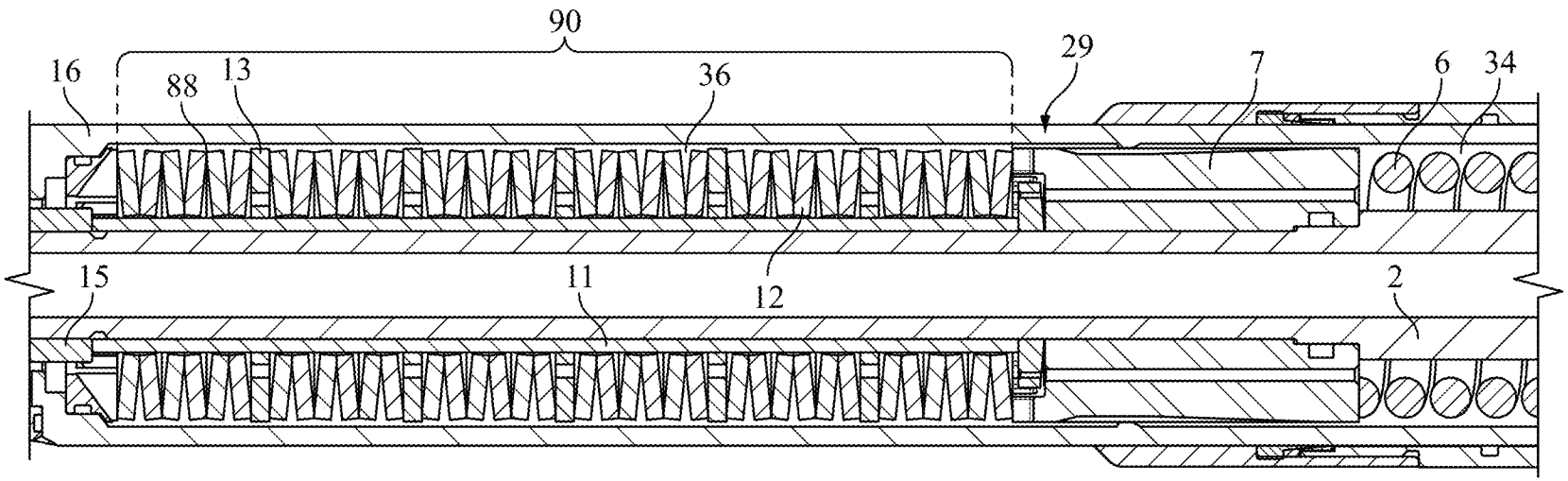
FIG. 22 is a schematic enlarged longitudinal cross-sectional view of a portion of the shock isolator showing the juxtaposition of a disparate spring type usage uphole and downhole of the damper piston subassembly, as shown in FIGS. 1C and 1D.

FIG. 22 is a schematic enlarged longitudinal cross-sectional view of a portion of the shock isolator showing the juxtaposition of a disparate spring type usage uphole and downhole of the damper piston subassembly, as shown in FIGS. 1C and 1D. Another feature of the invention is the use of a helical coil spring in the lower spring chamber 34 of the spring housing 16. Traditionally, such shock isolators use disk springs for the compression and rebound. For a spring with a stack of disk springs, such as Belleville disk springs, to function properly, the stack of disk springs must remain preloaded and then against each other throughout the whole travel range. In other words, the individual disks cannot separate from other disks during the whole stroke for either compression or rebound. Otherwise, the spring constant of the stack of disk springs will become chaotic and then the spring-damper system of shock isolator becomes chaotic. It has been discovered that the performance of the shock isolator of the invention can be improved by having a combination of disk springs for compression and one or more helical coils for rebound, especially when the rebound spring length at neutral position is only a fraction of that of compression spring. This combination overcomes the challenge of maintaining a preload for both compression and rebound springs throughout the whole stroke lengths of both compression and rebound.

Other and further embodiments utilizing one or more aspects of the inventions described above can be devised without departing from the disclosed invention as defined in the claims. For example, other embodiments can include the number of disks, extending spline teeth from the splined bulkhead and receiving spline teeth from the lower mandrel, switching the external spline from the lower mandrel to the upper mandrel, various locations of the components along the longitudinal axis that are different from as shown, varying numbers of types of openings and orifices, and other variations than those specifically disclosed herein within the scope of the claims.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intend to protect fully all such modifications and improvements that come within the scope of the following claims.

What is claimed is:

1. A shock isolator for downhole well drilling, comprising:

a housing having an inner periphery; and a damper piston subassembly having a damper piston configured to be inserted into the inner periphery, having an outer periphery smaller than the inner periphery to form an annular orifice between the housing and the damper piston subassembly, the damper piston subassembly being longitudinally moveable relative to the housing, the damper piston formed with a longitudinal variable depth damping orifice on the outer periphery of the damper piston, the damping orifice having a taper on a first end of the damping orifice, and a second taper on a second end of the damping orifice that forms a variable flow zone for fluid based on a relative position of the damper piston subassembly in the housing and configured to control a damping and response time of the shock isolator to reciprocal compression and return.

2. The shock isolator of claim 1, wherein the damper piston comprises a longitudinal piston opening formed inward of the outer periphery and further comprising a unidirectional valve having a sealing portion flexibly coupled over an end of the damper opening across a damper piston face and having a hub portion fixedly coupled to the damper piston face radially distal from the piston opening and configured to allow the unidirectional valve to longitudinally bend away from the damper piston face and allow flow through the piston opening in a first direction and longitudinally close over the damper piston face to restrict flow in a second direction to control a damping and response time of the shock isolator to reciprocal compression and return.

3. The shock isolator of claim 2, wherein the unidirectional valve comprises an alignment portion configured to engage a locating pin in the damper piston, the alignment portion having a first radius to the hub portion, and the sealing portion having a second radius to the hub portion, the second radius being greater than the first radius.

4. The shock isolator of claim 2, wherein the unidirectional valve comprises an alignment portion configured to engage a locating pin in the damper piston with a pin opening, the pin opening having a length radially aligned with a longitudinal axis of the damper piston and a width transverse to the length, the length being greater than the width.

5. The shock isolator of claim 2, wherein the damper piston comprises a limit plate coupled to the damper piston face and configured to limit bending of the unidirectional valve, the limit plate being tapered to allow the unidirectional valve to bend at an increasing distance from the damper piston face as a radial distance increases from a longitudinal axis of the damper piston.

6. The shock isolator of claim 2, wherein the damper piston comprises a limit plate coupled to the damper piston face, the limit plate having a relief opening aligned with a sealing portion of the unidirectional valve and configured to relieve vacuum on a backside of sealing portion when flow reverses through the piston subassembly to allow the sealing portion to return to a sealing position over the piston opening.

7. The shock isolator of claim 2, wherein the damper piston comprises a flow slot that is open to an outer periphery of the damper piston and configured to form a flow passage between the outer periphery of the damper piston and the piston opening.

8. The shock isolator of claim 1, wherein the shock isolator further comprises a splined bulkhead rotationally coupled to the housing and further comprising a lower mandrel and an upper mandrel, at least one of the mandrels having an involute spline having an involute tooth shape configured to fit a corresponding involute spline on the splined bulkhead to rotationally couple the mandrels with the housing.

9. The shock isolator of claim 1, further comprising a mandrel located radially inward from the housing, forming an annular spring chamber between the housing and mandrel, the spring chamber having at least two disk spring stacks separated by a disk, each disk spring stack having at least one compressible disk spring.

10. The shock isolator of claim 9, wherein the disk is configured to slide with less force in the annular chamber than the disk spring.

11. The shock isolator of claim 9, wherein the disk comprises a disk orifice for fluid flow across the disk spring stacks.

12. The shock isolator of claim 9, wherein the disk spring stacks comprise a first disk spring stack having a first spring constant and a second disk spring stack having a second spring constant that is different than the first spring stack constant.

13. The shock isolator of claim 1, further comprising a mandrel located radially inward from the housing, forming an annular first spring chamber between the housing and mandrel having a plurality of disk springs and an annular second spring chamber having a helical spring to oppose compression of the first spring chamber.

14. A shock isolator for downhole well drilling, comprising:

a housing having an inner periphery;

a damper piston subassembly having a damper piston configured to be inserted into the inner periphery having an outer periphery smaller than the inner periphery, the damper piston subassembly being longitudinally moveable relative to the housing, the damper piston formed with a longitudinal piston opening formed inward of the outer periphery;

a unidirectional valve having a sealing portion flexibly coupled over an end of the piston opening across a damper piston face and having a hub portion fixedly coupled to the damper piston face radially distal from the piston opening and configured to allow the unidirectional valve to longitudinally bend away from the damper piston face and allow flow through the piston opening in a first direction and longitudinally close over the damper piston face to restrict flow in a second direction to control a damping and response time of the shock isolator to reciprocal compression and return; and a limit plate coupled with the unidirectional valve and the damper piston that forms a travel space between the damper piston face and a limit plate face, the limit plate face having a taper that longitudinally progressively increases a travel space as a distance from the hub portion to the sealing portion increases.

15. The shock isolator of claim 14, wherein the unidirectional valve further comprises an alignment portion configured to engage a locating pin in the damper piston, the alignment portion having a first radius to the hub portion, and the sealing portion having a second radius to the hub portion, the second radius being greater than the first radius.

16. The shock isolator of claim 14, wherein the unidirectional valve comprises an alignment portion configured to engage a locating pin in the damper piston with a pin opening, the pin opening having a length radially aligned with a longitudinal axis of the damper piston and a width transverse to the length, the length being greater than the width.

17. The shock isolator of claim 14, wherein the limit plate comprises a relief opening aligned with a sealing portion of the unidirectional valve and configured to relieve vacuum on a backside of the sealing portion when flow reverses through the piston subassembly to allow the sealing portion to return to a sealing position over the piston opening.

18. The shock isolator of claim 14, wherein the damper piston comprises a flow slot that is open to an outer periphery of the damper piston and configured to form a flow passage between the outer periphery of the damper piston and the piston opening.

19. The shock isolator of claim 14, wherein the damper piston further comprises a longitudinal variable depth damping orifice on the outer periphery of the damper piston, the damping orifice having a taper on a first end of the damping orifice, and a second taper on a second end of the damping orifice that forms a variable flow zone for fluid based on a relative position of the damper piston in the housing and configured to control a damping and response time of the shock isolator to reciprocal compression and return.

20. The shock isolator of claim 14, wherein the shock isolator further comprises a splined bulkhead rotationally coupled to the housing and further comprising a lower mandrel and an upper mandrel, at least one of the mandrels having an involute spline configured to fit a corresponding involute spline on the splined bulkhead to rotationally couple the mandrels with the housing.

21. The shock isolator of claim 14, further comprising a mandrel located radially inward from the housing, forming an annular spring chamber between the housing and the mandrel, the spring chamber having at least two disk spring stacks separated by a disk, each disk spring stack having at least one compressible disk spring.

22. The shock isolator of claim 21, wherein the disk is configured to slide with less force in the annular chamber than the disk spring.

23. The shock isolator of claim 21, wherein the disk comprises a disk orifice for fluid flow across the disk spring stacks.

24. The shock isolator of claim 21, wherein the disk spring stacks comprise a first disk spring stack having a first spring constant and a second disk spring stack having a second spring constant that is different than the first spring stack constant.

25. The shock isolator of claim 14, further comprising a mandrel located radially inward from the housing, forming an annular first spring chamber between the housing and mandrel having a plurality of disk springs and an annular second spring chamber having a helical spring to oppose compression of the first spring chamber.

* * * * *